US009754690B2

(12) United States Patent
Rebar et al.

(10) Patent No.: US 9,754,690 B2
(45) Date of Patent: Sep. 5, 2017

(54) FLEXIBLE HIGHLY FILLED COMPOSITION, RESULTING PROTECTIVE GARMENT, AND METHODS OF MAKING THE SAME

(71) Applicant: Lite-Tech, Inc., Norristown, PA (US)

(72) Inventors: Victoria A. Rebar, Norristown, PA (US); Andrew B. Crawford, Allamuchy, NJ (US); Nicholas A. Moses, Yardley, PA (US); David M. Krug, Gladwyne, PA (US)

(73) Assignee: LITE-TECH, INC., Norristown, PA (US)

( * ) Notice: Subject to any disclaimer, the term of this patent is extended or adjusted under 35 U.S.C. 154(b) by 719 days.

(21) Appl. No.: 14/068,297

(22) Filed: Oct. 31, 2013

(65) Prior Publication Data

US 2014/0117288 A1 May 1, 2014

Related U.S. Application Data

(60) Provisional application No. 61/720,553, filed on Oct. 31, 2012.

(51) Int. Cl.
*G21F 1/10* (2006.01)
*G21F 3/025* (2006.01)

(52) U.S. Cl.
CPC ..... *G21F 1/106* (2013.01); *G21F 3/025* (2013.01)

(58) Field of Classification Search
CPC ..... G21F 1/106
See application file for complete search history.

(56) References Cited

U.S. PATENT DOCUMENTS

| | | | | |
|---|---|---|---|---|
| 2,328,105 | A | 8/1943 | Strobino | |
| 2,404,225 | A | 7/1946 | Green | |
| 2,451,282 | A | 10/1948 | Feibel | |
| 2,494,664 | A | 1/1950 | Lubow | |
| 2,642,542 | A | 6/1953 | Weinberg | |
| 3,039,001 | A | 6/1962 | Park et al. | |
| 3,045,121 | A | 7/1962 | Leguillon | |
| 3,052,799 | A | 9/1962 | Hollands | |
| 3,093,829 | A | 6/1963 | Maine | |
| 3,239,669 | A | 3/1966 | Weinberger | |
| 3,308,297 | A | 3/1967 | Mansker | |
| 3,310,053 | A | 3/1967 | Greenwood | |
| 3,996,620 | A | 12/1976 | Maine | |
| 4,110,414 | A * | 8/1978 | Lindsay | C08L 23/06 525/240 |
| 4,129,524 | A | 12/1978 | Nagai et al. | |
| 4,132,698 | A * | 1/1979 | Gessler | C08L 23/02 524/518 |
| 4,196,355 | A | 4/1980 | Maine | |
| 4,220,867 | A | 9/1980 | Bloch, Jr. | |
| 4,286,170 | A | 8/1981 | Moti | |
| 4,386,277 | A | 5/1983 | Forshee | |
| 4,417,146 | A | 11/1983 | Herbert | |
| 4,441,025 | A | 4/1984 | McCoy | |
| 4,467,476 | A | 8/1984 | Herbert | |
| 4,581,538 | A | 4/1986 | Lenhart | |
| 4,670,658 | A | 6/1987 | Meyers | |
| 4,766,608 | A | 8/1988 | Cusick et al. | |
| 4,843,641 | A | 7/1989 | Cusick et al. | |
| 4,924,103 | A | 5/1990 | Stein et al. | |
| 4,938,233 | A | 7/1990 | Orrison, Jr. | |
| 5,001,176 | A * | 3/1991 | Nakazima | C08K 5/05 524/108 |
| 5,015,864 | A | 5/1991 | Maleki | |
| 5,015,865 | A | 5/1991 | Sayers | |
| 5,028,796 | A | 7/1991 | Swartz | |
| 5,177,056 | A | 1/1993 | Hilti et al. | |
| 5,220,175 | A | 6/1993 | Cole | |
| 5,245,195 | A | 9/1993 | Shah et al. | |
| 5,247,182 | A | 9/1993 | Servant et al. | |
| 5,274,851 | A | 1/1994 | Simkins, Jr. et al. | |
| 5,278,219 | A | 1/1994 | Lilley et al. | |
| 5,419,342 | A | 5/1995 | Scott | |
| 5,952,396 | A | 9/1999 | Chang | |

(Continued)

FOREIGN PATENT DOCUMENTS

| | | |
|---|---|---|
| EP | 0304403 A2 | 2/1989 |
| RU | 2419634 C2 | 5/2011 |
| WO | 2011015790 | 2/2011 |

OTHER PUBLICATIONS

Lloyd W. Klein, Donald L. Miller, MD, Stephen Baiter, PhD, Warren Laskey, MD, David Haines, MD, Alexander Norbash, MD, Matthew A. Mauro, MD and James A. Goldstein, MD, Occupational Health Hazards in the Interventional Laboratory: Time for a Safer Environment. Radiology, vol. 250, No. 2, 2009, pp. 538-544.

Pelz, DM. Low back pain, lead aprons, and the angiographer. AJNR Am J Neuroradiol 2000; 21:1364.

Moore, B., vanSonnenberg, E., Casola, G. and Novelline, R.S. The relationship between back pain and lead apron use in radiologists. AJR Jan. 1992 vol. 158 No. 1 191-193.

C. Mattmann, G. Troster, Design Concept of Clothing Recognizing Back Postures, Proc. 3rd IEEE-EMBS International Summer School and Symposium on Medical Devices and Biosensors (ISSS-MDBS 2006), Boston, Sep. 4-6, 2006.

Mattmann, C. Amft, O. Harms, H. Troster, G. Clemens, F., Recognizing Upper Body Postures using Textile Strain Sensors, ISWC '07 Proceedings of the 2007 11th IEEE International Symposium on Wearable Computers, Oct. 11-13, 2007, pp. 1-8.

(Continued)

*Primary Examiner* — Peter F Godenschwager
(74) *Attorney, Agent, or Firm* — Duane Morris LLP

(57) ABSTRACT

A filled composition for radiation shielding includes at least one polymer ingredient and at least one metal-containing filler. The at least one polymer ingredient is selected from the group consisting of a polyolefin elastomer, a polyolefin co-polymer, a polyolefin ter-polymer, and a combination thereof. The polyolefin elastomer, the polyolefin co-polymer, or the polyolefin ter-polymer includes monomer units derived from ethylene and at least one vinyl monomer having more than three carbon atoms. The at least one metal-containing filler is selected from a metal filler, a metal compound or a combination thereof.

27 Claims, 11 Drawing Sheets

(56) References Cited

U.S. PATENT DOCUMENTS

| | | | | |
|---|---|---|---|---|
| 5,981,964 | A | 11/1999 | McAuley et al. | |
| 6,153,666 | A | 11/2000 | Lagace | |
| 6,281,515 | B1 | 8/2001 | Demeo et al. | |
| 6,448,571 | B1 | 9/2002 | Goldstein | |
| 6,459,091 | B1 | 10/2002 | Demeo et al. | |
| 6,548,570 | B1 | 4/2003 | Lange | |
| 6,548,600 | B2 * | 4/2003 | Walton | C08K 5/0025 525/191 |
| 6,674,087 | B2 | 1/2004 | Cadwalader et al. | |
| 6,828,578 | B2 | 12/2004 | DeMeo et al. | |
| 6,841,791 | B2 | 1/2005 | DeMeo et al. | |
| 7,041,995 | B2 | 5/2006 | Eder | |
| 7,193,230 | B2 | 3/2007 | Lagace et al. | |
| 7,258,484 | B2 | 8/2007 | Korhonen | |
| 7,294,845 | B2 | 11/2007 | Ballsieper | |
| 7,432,519 | B2 | 10/2008 | Ballsieper | |
| 7,476,889 | B2 | 1/2009 | DeMeo et al. | |
| 7,488,963 | B2 | 2/2009 | Lagace et al. | |
| 7,608,847 | B2 | 10/2009 | Rees | |
| 7,897,949 | B2 | 3/2011 | Ballsieper | |
| 7,973,299 | B2 | 7/2011 | Rees | |
| 8,198,616 | B2 | 6/2012 | Rees | |
| 8,283,407 | B2 | 10/2012 | Waddell et al. | |
| 8,334,524 | B2 | 12/2012 | DeMeo et al. | |
| 2007/0080308 | A1 | 4/2007 | Mousavi Yeganeh | |
| 2007/0152197 | A1 | 7/2007 | Lagace et al. | |
| 2008/0161507 | A1 * | 7/2008 | Chakravarti | C08L 67/00 525/439 |
| 2009/0000007 | A1 | 1/2009 | DeMeo | |
| 2011/0163248 | A1 | 7/2011 | Beck | |
| 2011/0241262 | A1 * | 10/2011 | Siddhamalli | B29C 47/0011 264/471 |
| 2012/0012793 | A1 | 1/2012 | Liu et al. | |
| 2012/0181458 | A1 | 7/2012 | Leucht et al. | |

OTHER PUBLICATIONS

Policy on X-Ray Protective Clothing, Dept. of Environment Climate Change and Water NSW, Sydney, Australia, Nov. 2009.
Testing Lead Aprons Used in Diagnostic Radiology Departments, Radiation Safety, Melbourne, Victoria Environmental Health Unit, 2011.
Ionizing Radiation Protective Device Inventory & Inspection, Univ. of Texas—San Antonia Health Science Center, Environmental Health and Sfety Department, Radiation Safety Division, Aug. 10, 2009.
Radiation Protective Devices—Inventory and Inspection, Univ. of Arkansas, General and Occupational Safety, Oct. 5, 2011.
The Use and Care of Lead Protective Equipment, Radiology Compliance Branch, Division of Health Service Regulation, NC Department of Health and Human Services, Dec. 29, 2011.
Stam, W., and Pillay, M., Inspection of Lead Aprons: A Practical Rejection Model, Health Phys. Aug. 2008;95 Suppl 2: S133-6.
Oyar, O., Kislalioglu, A., How Protective are the Lead Aprons We Use Against Ionizing Radiation? Diagn Interv Radiol. Mar.-Apr. 2012;18(2):147-52. Epub Sep. 24, 2011.
Muir S, Mcleod R, Dove R (2005). Light-weight lead aprons—light on weight, protection or labeling accuracy? Australas. Phys Eng Sci Med Jun; 28(2):128-30.
J So, MS, NY, NY; E L Nickoloff, DSc; Z. Lu, PhD; A K Dutta, MS., "Testing of Materials Used in Manufacture of Radiation Protection Garments Using the IEC 1331-1 Protocol," Abstract submitted by Columbia University Radiology, Europrotex.
Rebuttal to the Technical Report "Light-weight lead aprons—light on weight, protection or labeling accuracy?" Infab Corp., Feb. 2009.
"A Challenge to BLOX-R and a warning to anyone involved in the use or procurement of flexible radiation materials," Posted on Jun. 21, 2013 by Infab Corporation, http://www.infabcorp.com/open-letter-to-bloxr/, accessed Aug. 8, 2013.
IEC 61331-1:1994, "Protective devices against diagnostic medical X-radiation—Part 1: Determination of attenuation properties of materials."
DIN 6857-1, "Radiation protection accessories for medical use of X-radiation—Part 1: Determination of shielding properties of unleaded or lead reduced protective clothing," 2009, shown in Bleischürzen—ein Vergleich, Konventionelle Schürze versus bleifreier,, Leichtschürze pp. 6-7.
ASTM F2547-06, Standard Test Method for Determining the Attenuation Properties in a Primary X-ray Beam of Materials Used to Protect Against Radiation Generated During the Use of X-ray Equipment.
Engage 8150, Dow Technical Information, May 2008.
Infuse 9000, Dow Technical Information, May 12, 2008.
Product Information—Sunoco Sunpar Range, Petronas Lubricants Belgium NV, Jun. 2009.
Elvax 265 Product Data Sheet, EI DuPont de Nemours and Company, Feb. 16, 2011.
Nytex 5450 Safety Data Sheet, Nynas USA, Jan. 31, 2008.
Nordel IP 3745P Technical Information Sheet, DuPont Dow Elastomers, Rev 3, Jun. 2002.
BNX 1225 Antioxidant & Thermal Stabilizer Blend, Product Data Sheet, Mayzo, Inc. Sep. 29, 2010.
Corresponding PCT Application No. PCT/US 2013/067782 International Search Report and Written Opinion.
Supplementary European Search Report and European search opinion issued on Apr. 14, 2016, for corresponding European patent application No. 13850930.2, 7 pages.
Kemamide U, Material Safety Data Sheet, Chemtura, Jun. 26, 2007.
"Standard X-Ray Protection," Optibelt website, http://www.optibelt.com, accessed Aug. 22, 2013.
"Lead Vinyl Sheeting," Shielding website, http://www.shieldingintl.com, accessed Aug. 22, 2013.
"LeadX Lead Vinyl," Bar Ray website, https://www.bar-ray.com, accessed Aug. 22, 2013.
"Design Guidelines for Preventing Flex Cracking Failures in Ceramic Capacitors," N. Blattau, D. Barker, and C. Hillman CARTS 2003: 23rd Capacitor and Resistor Technology Symposium, Mar. 31-Apr. 3, 2003.
"Bending, Forming and Flexing Printed Circuits," John Coonrad (Rogers Corp.), paper IPC Printed Circuits Expo 2007 Conference Proceedings.
Blake E. Matthies, Edward R. Terrill, Abraham Pannikottu, C. Robert Samples, and James T. Lewis, Akron Rubber Development Laboratory, Inc., Paper # 68 Presented at a meeting of the Rubber Division, American Chemical Society, Pittsburgh, PA, Nov. 1-3, 2005.
ASTM Method D813, "Standard Test Method for Rubber Deterioration-Crack Growth," Reapproved 2000.
"Flex Testing," Intercon 1, A division or Nortech Systems website, www.intercon-1.com/uploads/Flex%20Testing.pdf, accessed Aug. 27, 2013.
"Camera Link Cable Assembly," Uniforce Sales and Engineering website, www.uniforcesales.com/docs/CLCableAssembly.pdf, accessed Aug. 27, 2013.
ASTM D412-06a, "Tensile Strength Properties of Rubber and Elastomers".
David Roylance, "Stress-Strain Curves", Massachusetts Institute of Technology, Cambridge 2011 web.mit.edu/course/3/3.11/www/modules/ss.pdf.
ASTM D624-00, "Standard Test Method for Tear Strength of Conventional Vulcanized Rubber and Thermoplastic Elastomers".
ASTM D2240-91, "Standard Test Method for Rubber Property—Durometer Hardness".
"Determining the Modulus of Elasticity in Compression via the Shore A Hardness," Kunz, Johannes; Studer, Mario, Kunststoffe International, Jun. 2006.
"Characterisation of Fabric Drape Using Spectral Functions," Kokas-Palicska, Livia; Szucs, Ivan; Borka, Zsolt, Acta Polytechnica Hungarica, vol. 5, 2008.
"Fabric and Garment Drape Measurement," Sanad, Reham;Cassidy, Tom; Cheung, Vien, Journal of Fiber Bioengineering & Informatics 5:4 (2012) 341-358 http://www.jfbi.org | doi:10.3993/jfbi12201201.
Environmental Stress Cracking—The Plastic Killer, Jeffrey A. Jansen, Advanced Materials & Processes Jun. 2004, pp. 50-53.

(56) References Cited

OTHER PUBLICATIONS

Environmental Stress Cracking of Plastics, D. C. Wright, ASM International(OH), 2001, excerpts from chapters 1 and 2.
Ansems, P., Soediono, M., Taha, A., "Oil Extension of Olefin Block Copolymers," ANTEC Conference Proceedings—2007, vol. 2, pp. 959-963.
H. P. Wang, S. P. Chum, A. Hiltner, and E. Baer, "Comparing Elastomeric Behavior of Block and Random Ethylene-Octene Copolymers," J. Appl. Polym. Sci., vol. 113, 3236-3244 (2009).

* cited by examiner

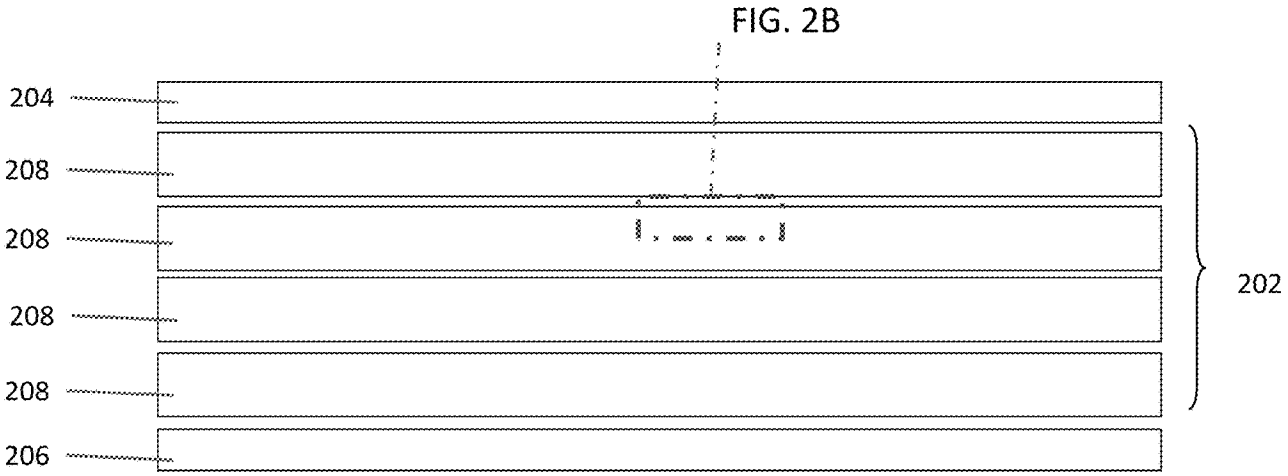
FIG. 2B
FIG. 2A
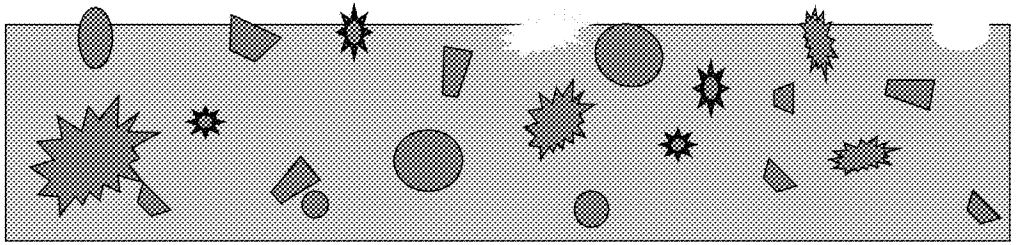
FIG. 2B

FLEXIBLE HIGHLY FILLED COMPOSITION, RESULTING PROTECTIVE GARMENT, AND METHODS OF MAKING THE SAME

RELATED APPLICATIONS

This application claims the benefit of U.S. Provisional Application No. 61/720,553, filed Oct. 31, 2012, which application is expressly incorporated by reference herein in its entirety.

FIELD

The present disclosure relates to polymer composition and protective garments. More particularly, the disclosed subject relates to filled polymer compositions, resulting protective garments for radiation protection, and methods of making the same.

BACKGROUND

Protective garments and related equipment are designed to protect a user's body from harm or injury caused by hazards such as radiation. Ionizing radiation is widely used in industry, medicine and laboratory, and it presents a significant health hazard. Radiation blocking garments can shield a user's body and block radiation. For example, X-ray blocking garments are worn by people exposed to non-enclosed (open) X-ray beams having energies between 60 and 120 kV. In addition to efficiency in blocking radiation, it is desirable for radiation blocking garments to have good mechanical properties and chemical resistance.

SUMMARY OF THE INVENTION

The present disclosure provides a filled composition for blocking radiation such as X-ray, a resulting sheet comprising such a filled composition, a resulting protective garment comprising such a filled composition, and the methods of making the same.

In some embodiments, the filled composition comprises at least one polymer ingredient and at least one metal-containing filler. The at least one polymer ingredient is selected from the group consisting of a polyolefin elastomer, a polyolefin co-polymer, a polyolefin ter-polymer, and a combination thereof. The polyolefin elastomer, the polyolefin co-polymer, or the polyolefin ter-polymer comprises monomer units derived from ethylene and at least one vinyl monomer having more than three carbon atoms, for example, from four to ten carbon atoms. The at least one metal-containing filler is selected from a metal filler, a metal compound and a combination thereof.

In some embodiments, the at least one polymer ingredient comprises a polyolefin elastomer (POE). The POE, for example, can be a copolymer of ethylene and at least one vinyl monomer selected from the group consisting of butene, pentene, hexene, heptene, octene and a combination thereof. In some embodiments, the at least one polymer ingredient comprises a polyolefin elastomer (POE) comprising a copolymer of ethylene and octene.

In some embodiments, the at least one polymer ingredient comprises an olefin block copolymer (OBC) having alternating blocks of rigid and elastomeric segments. The OBC can be a copolymer of ethylene and at least one vinyl monomer selected from the group consisting of butene, pentene, hexene, heptene, octene and a combination thereof. For example, an OBC can be a copolymer of ethylene and octene.

In some embodiments, the at least one polymer ingredient further comprises an ethylene-vinyl acetate copolymer, an ethylene-propylene-diene (EPDM) ter-polymer, or a combination thereof.

In some embodiments, the at least one metal-containing filler comprises a metal having an atomic number greater than 50. For example, the at least one metal-containing filler comprises Sb, W, Ba, Pb, Bi, an alloy thereof, an oxide thereof, a salt thereof, or a combination thereof. In some embodiments, the at least one metal-containing filler can be substantially free of Pb, and comprises a filler selected from Sb, W, Bi, $BaSO_4$, and a combination thereof.

The filled composition can further comprise an additive package, which comprises an additive selected from the group consisting of a paraffinic oil, an aromatic oil, an antioxidant, a compatibilizer, an adhesion promoter, a processing aid, and a combination thereof. In some embodiments, the filled composition is uncrosslinked. In some other embodiments, the filled composition is cross-linkable, and the additive package further comprises an initiator, a curing agent, an accelerator, or a combination thereof.

In the filled composition, the at least one polymer ingredient constitutes from about 0.4 weight percent (wt. %) to about 35 wt. %, the at least one metal-containing filler constitutes from about 50 wt. % to about 95.5 wt. %, and the additive package constitutes from about 0.1 wt. % to about 15 wt. %. In some embodiments, the at least one polymer ingredient is in the range of from about 1 wt. % to about 25 wt. %, for example, from about 10 wt. % to about 15 wt. %. The at least one metal-containing filler is in the range of from about 60 wt. % to about 95 wt. %, for example, from about 75 wt. % to about 85 wt. %. The additive package is in the range of from about 4 wt. % to about 15 wt. %, for example, from about 5 wt. % to about 10 wt. %. In some embodiments, the additive package comprises a paraffinic oil in the range of from about 5 wt. % to about 9 wt. % of the filled composition.

The present disclosure also provides a filled sheet for radiation shielding, comprising the filled composition as described. In some embodiments, for example, the filled sheet comprises from about 0.4 wt. % to about 35 wt. % of at least one polymer ingredient, from about 50 wt. % to 95.5 wt. % of at least one metal-containing filler, and from about 0.1 wt. % to about 15 wt. % of an additive package. The at least one polymer ingredient is selected from the group consisting of a polyolefin elastomer, a polyolefin co-polymer, a polyolefin ter-polymer, and a combination thereof. The polyolefin elastomer, the polyolefin co-polymer, or the polyolefin ter-polymer comprises monomer units derived from ethylene and at least one vinyl monomer having more than three carbon atoms, from example, from four to ten carbon atoms. Examples of the at least one polymer ingredient include but are not limited to a polyolefin elastomer (POE) and an olefin block copolymer (OBC) as described above.

The at least one metal-containing filler is selected from a metal filler, a metal compound and a combination thereof. For example, the at least one metal-containing filler comprises Sb, W, Ba, Pb, Bi, an alloy thereof, an oxide thereof, a salt thereof, or a combination thereof. The additive package comprising an additive selected from the group consisting of a paraffinic oil, an aromatic oil, an antioxidant, a compatibilizer, an adhesion promoter, a processing aid, and a combination thereof. The filled sheet can be uncrosslinked.

In some other embodiments, the filled sheet can be crosslinkable or crosslinked. A crosslinkable filled sheet can further comprise an initiator, a curing agent, and/or accelerator.

The present disclosure also provides a protective garment for radiation shielding, comprising a filled composition described above. In some embodiments, the protective garment further comprises at least one layer of fabric such as nylon, polyester and combinations thereof. For example, in some embodiments, the protective garment comprises two outer layers of fabric, which encase one or more inner layers of a filled sheet. The protective garment can be in a suitable design including but are not limited to a vest-skirt apron, a frontal apron, and a dental apron. In some embodiments, the filled composition in the protective garment is uncrosslinked. In some other embodiments, the filled composition is crosslinked.

The filled composition and filled sheet have high efficiency in shielding or blocking radiation, excellent abrasion resistance, flexibility, and environmental stress cracking resistance, for example, after exposure to isopropyl alcohol. The protective garment is configured to shield radiation, for example, blocking X-rays, and is expected to survive the normal use for more than two years.

The present disclosure also provides method of making the filled composition, the filled sheet and the protective garment described above.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like reference numerals denote like features throughout specification and drawings.

FIG. 2A is a diagram illustrating a layer construction of X-ray blocking garment in accordance with some embodiments. FIG. 2B is a detailed illustration of a filled polymer sheet, showing likely surface structure.

DETAILED DESCRIPTION

Figure 1A:
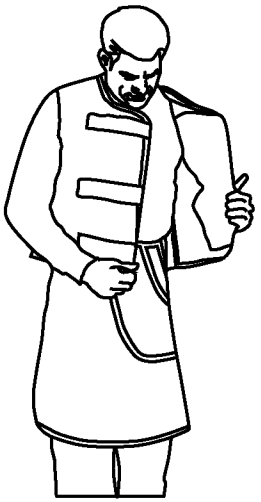
FIGS. 1A-1C illustrate different styles of X-ray blocking aprons in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" refer to a relationship wherein structures are secured or attached to one another either directly or indirectly through intervening structures, as well as both movable or rigid attachments or relationships, unless expressly described otherwise.

The present disclosure provides a filled composition for blocking radiation such as X-rays, a resulting sheet comprising such a filled composition, a resulting protective garment comprising such a filled composition, and the methods of making the same. The resulting protective garments can include radiation protection garments such as X-ray blocking garments.

Figure 1B:
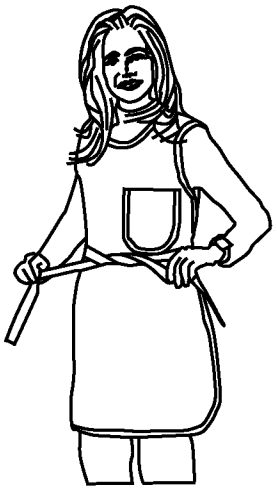
Figure 1C:
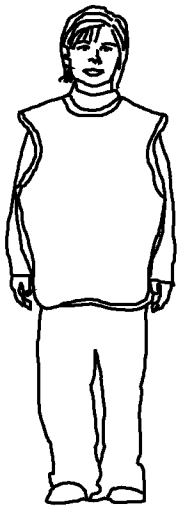

X-ray blocking garments can include vest-skirt combinations, frontal aprons, dental drapes, thyroid collars, gonad shields, and combinations thereof. FIGS. 1A-1C illustrate vest-skirt aprons, frontal aprons and dental aprons, respectively, in accordance with some embodiments. As shown in FIG. 2A, a garment 200 for blocking radiation such as X-rays comprises two major components: 1) at least one layer of fabric such as outer layers 204 and 206 of non X-ray blocking fabric, such as nylon or polyester, which encase 2) at least one filled sheet or layer 202 comprising one or more inner layers 208 of highly filled polymer/heavy metal composite sheet, which absorbs the X-rays. The layers 204, 206 and 208 are stitched together. Each layer has a suitable thickness. For example, each of inner layers 208 in the at least one filled sheet 202 can be 15-25 mils (i.e. 381-635 microns) thick. Each of the outer layers 204 and 206 of fabric can have a thickness in the range of from 10 mils to 12 mils (i.e. from 254 microns to 305 microns). As shown in FIG. 2B, the filled sheets or layers 202 are highly filled with different metal particles. The size of the metal particles can be at micron level, for example, in the range of from 1 micron to 70 microns. The metal particles may protrude from surface creating roughness, or even fall out leaving craters, as shown in FIG. 2B.

Feeling comfort while wearing the garment for long periods is important, as its significant weight, between 7 and 15 pounds, exerts much force on the body. Elastic and Velcro fasteners are often attached to the fabric to secure the garment and comfort the wearers. Some efforts have been tried to address the effects of the extra weight, especially on the neck and back. In addition, design features such as placement of elastic and Velcro fasteners at the waist help "lift" the apron off the back. However, elastic and Velcro fasteners may subject the sheet to additional forces and deformation, which can result in premature development of holes and tears. The threads used to attach the Velcro also wear away at the layer of sheet next to it. The integrity of the filled sheet is of great concern to wearers, as holes and tears can cause the wearer to be exposed to unwanted X-ray radiation.

Figure 3B:
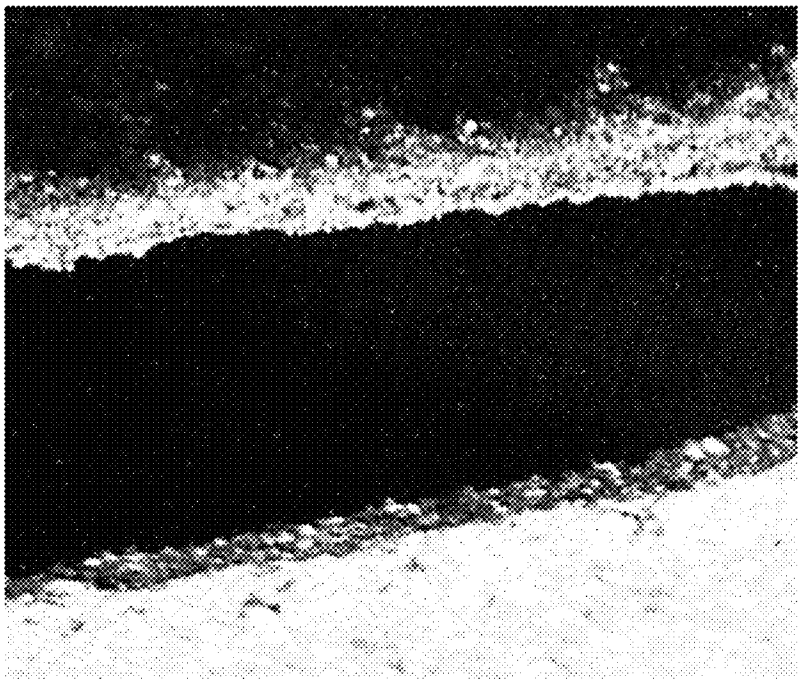
FIGS. 3A-3B illustrate potential surface problems with the existing products.
Figure 3A:
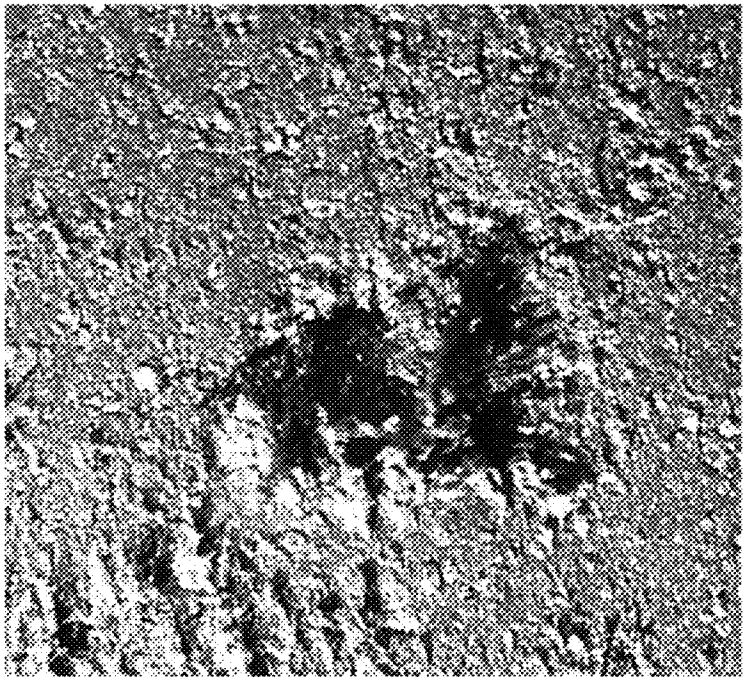
Figure 4B:
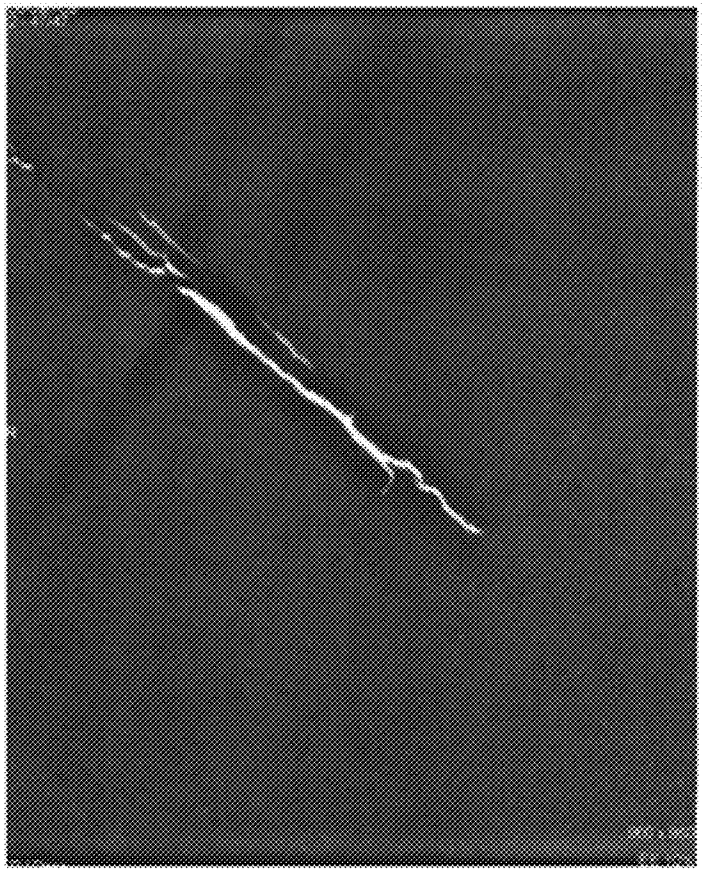
FIGS. 4A-4B, 5A-5B and 6A-6B illustrate holes and cracks in existing X-ray protection garments.
Figure 4A:
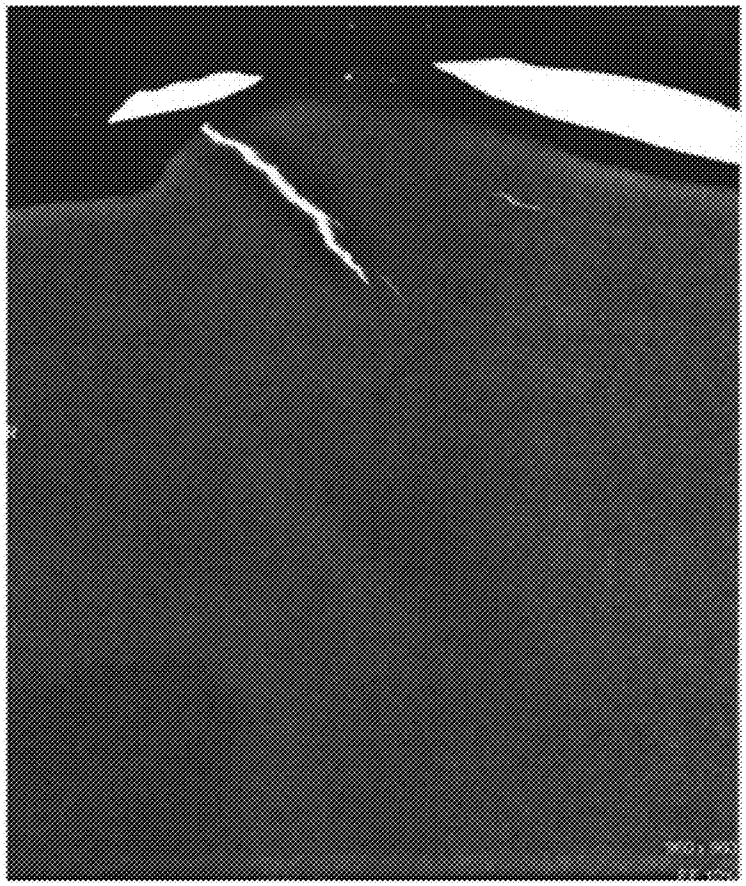
Figure 5B:
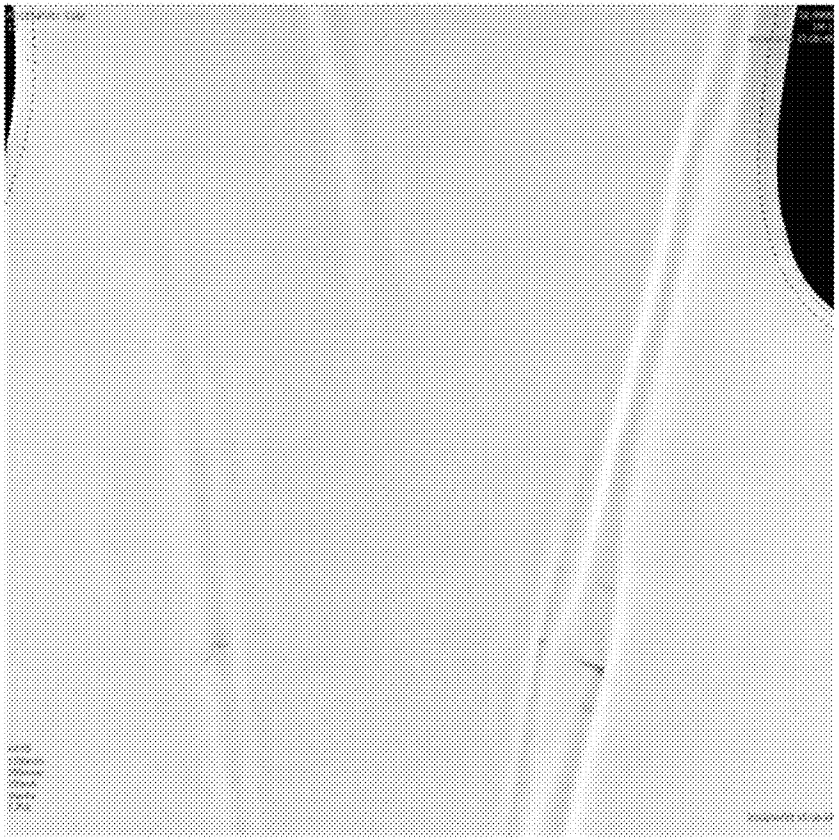
Figure 5A:
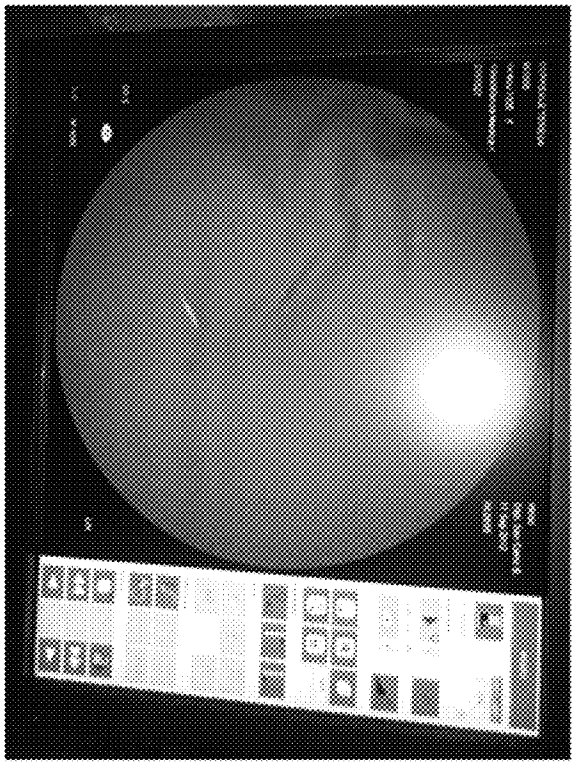
Figure 6A:
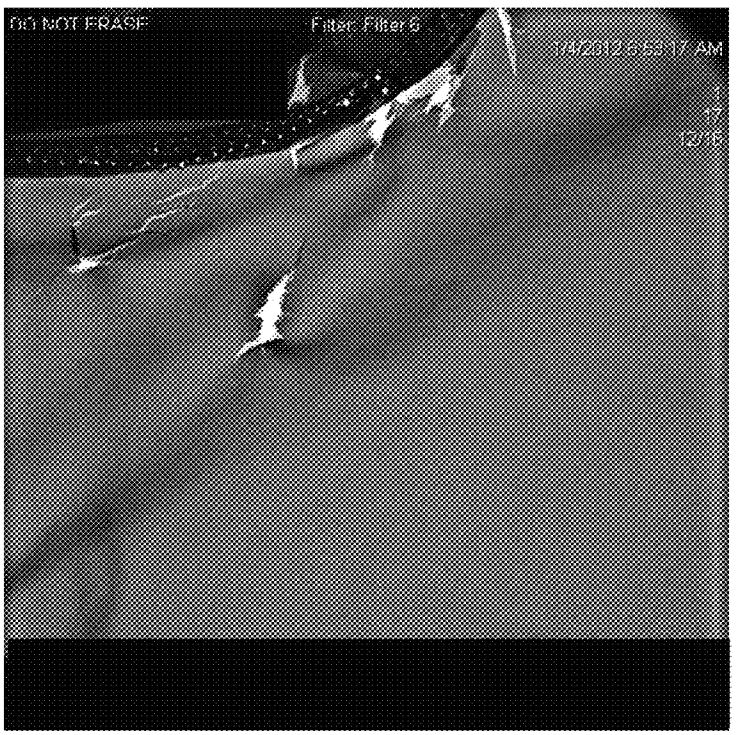
Figure 6B:
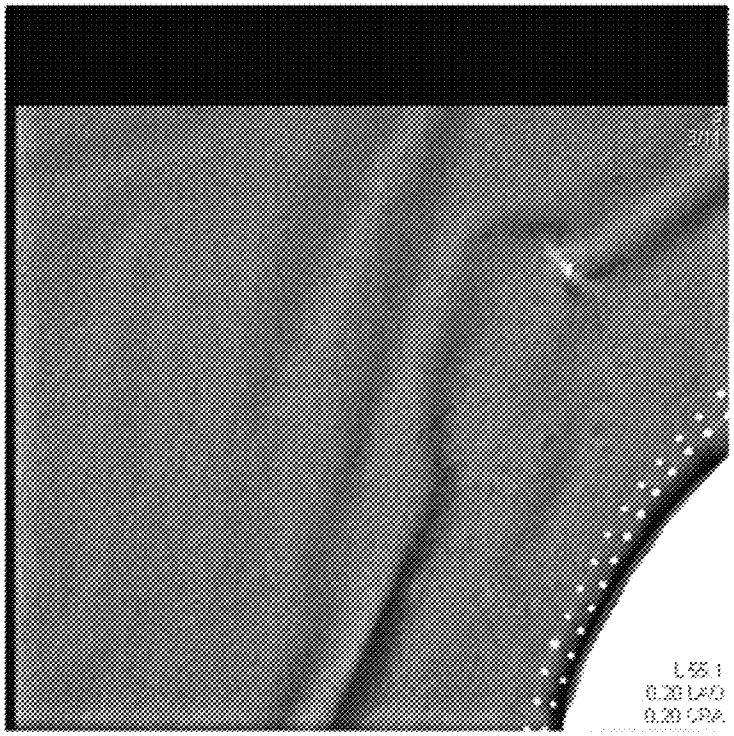

Besides the forces on it resulting from elastic and Velcro fasteners, the filled sheet undergoes strain during normal course of use. For example, folding the arms and bending over at the waist strain the back of a vest, with a recent paper reporting as much as 20% elongation in studies of garments on the upper body. This level of strain may accelerate premature failure because it simultaneously stretches the filled sheet while abrading it against other layers of filled sheet, and the fabric. This is an especially aggressive situation, as the filled sheet may have edges of metal particles protruding from it, which scrape away the other layers of sheet, as shown in FIG. 3A. Over time, the material is worn away and/or particles fall out, forming craters (as shown in FIG. 3A), which lead to holes. As illustrated in a side view of FIG. 3B, the filled sheet may also have sharp edges and an uneven surface.

Human motion also affects the integrity of the filled sheet within the garment because of the resulting flexing. For example, when a person wearing a full frontal apron sits down, the sections of filled sheet in the lap region are creased about 90 degrees. The angle may exceed 90 degrees if the wearer leans forward while sitting. Repeated sitting/leaning forward causes repeated flexing of the filled sheet in the same area of the lap region which eventually results in one or more holes forming due to flex-cracking. Furthermore, thicker sheets are likely to flex-crack faster than thinner ones.

Another motion that wears away the filled sheet within a protective garment is repeatedly leaning over a table or other hard surface. This action rubs the filled sheets against each other and against the layer of fabric.

Consequently, facilities worldwide that use open beam X-ray equipment employ inspection procedures for holes and tears in X-ray blocking aprons. For example, a rejection model for defects may be proposed. A large study of the integrity of eighty-five lead aprons in a hospital might be performed. Thus, the material failure of these garments is a large-scale, on-going and serious issue.

Manufacturers may guarantee an apron against material defects for a period of two years, as the quality of the care also affects its lifetime. The protective garments such as aprons are suggested to be hung on special hangers to avoid creases, which accelerate the development of holes and tears.

The use of incompatible cleaning fluids, such as alcohol, and improper procedures, such as using a washing machine, may also shorten the lifetime of a protective garment. X-ray blocking aprons may become soiled during normal use, as many procedures expose them to blood and other fluids. Manufacturers usually specify the safest and most effective cleaning method for their aprons. Alcohols are commonly used. However, many X-ray blocking compositions deteriorate upon exposure to alcohol, causing premature failure.

FIGS. 4A-4B, 5A-5B and 6A-6B show tears, holes and cracks developed in protective garments due to abuse and/or normal wear.

The inventor in the present disclosure has determined the cause to the problem of premature failure of a protective garment such as an apron, especially in the filled sheets, and has determined the solutions to such a problem. Such a premature problem results from the situation where the filled sheet is subjected to simultaneous application of 1) high strain, or elongations and 2) abrasion against itself and fabric. The filled composition and the filled sheet described in this disclosure display excellent mechanical properties including abrasion resistance and flex-cracking resistance. The filled composition and the filled sheet provided in this disclosure also display superior resistance to environmental stress cracking, for example, after exposure to alcohols for a long time. This disclosure also provides advantages with respect to processing and productivity of a filled sheet on a sheet extrusion line.

1. Filled Composition

In some embodiments, a filled composition for radiation shielding comprises at least one polymer ingredient and at least one metal-containing filler. Examples of a suitable polymer ingredient include but are not limited to a polyolefin elastomer, a polyolefin co-polymer, a polyolefin terpolymer, and a combination thereof. The polyolefin elastomer, the polyolefin co-polymer, or the polyolefin terpolymer comprises monomer units derived from ethylene and at least one vinyl monomer having more than three carbon atoms, for example, four to ten carbon atoms. The at least one metal-containing filler is selected from a metal filler, a metal compound and a combination thereof.

In some embodiments, the at least one polymer ingredient comprises a polyolefin elastomer (POE). For example, the POE comprises a copolymer of ethylene, and at least one vinyl monomer having at least four carbon atoms. Examples of the at least one vinyl monomer include but are not limited to butene, pentene, hexene, heptene, octene and a combination thereof. In some embodiments, the at least one polymer ingredient comprises a polyolefin elastomer (POE) comprising a copolymer of ethylene and octene. One example of a POE is available under a trade name ENGAGE™ from Dow Elastomers. ENGAGE™ polyolefin elastomers (POEs) are created using INSITE™ technology, a single-site catalyst and solution process technology. The technology integrates metallocene catalysts, the constrained-geometry, single-site homogeneous catalysts, with its polyethylene solution process. The related POEs include ethylene-butene coploymer and ethylene-octene copolymers. The POEs have a narrow or moderate molecular weight distribution (MWD), a melt index at 190° C. in the range from 0.5 gm/10 min to 30 gm/10 min, a density in the range of from 0.857 to 0.910, a glass transition temperature of from −61° C. to −35° C., a shore A hardness in the range of from 56-96, and a flexural modulus in the range from 3 MPa to 110 MPa.

In some embodiments, the at least one polymer ingredient comprises an olefin block copolymer (OBC) having alternating blocks of rigid and elastomeric segments. The OBC can be a copolymer of ethylene and at least one vinyl monomer having at least four carbon atoms. Examples of the at least one vinyl monomer include but are not limited butene, pentene, hexene, heptene, octene and a combination thereof. One example of the at least one polymer ingredient comprises an olefin block copolymer (OBC) of ethylene and octene.

One example of an olefin block copolymer (OBC) can be available under a trade name INFUSE™ from Dow Elastomers. INFUSE™ olefin block copolymers (OBCs) are polyolefins with alternating blocks of hard (highly rigid) and soft (highly elastomeric) segments. The block structure of OBCs offers an advantaged performance balance of flexibility and heat resistance compared to random polyolefin copolymers. This type of polymers also has good abrasion resistance.

In some embodiments, the polymer ingredient can be a copolymer or ter-polymer of ethylene and another vinyl monomer having more than three carbon atoms, for example, from four to ten carbon atoms. Examples of the vinyl monomer include but are not limited to butene, pentene, hexene, heptene, and octene. The vinyl monomer can have a longer chain structure, and the polymer ingredient has high molecular weight and high melt index for good flexibility and toughness. The copolymer or terpolymer can be in a random, block or comb configuration.

In some embodiments, nonpolar polymers are preferred. In some embodiments, the polymer ingredient can comprise another monomer such as vinyl acetate. In some embodiments, the polymer ingredient is a blend of two or three polymers. In some embodiments, the at least one polymer ingredient further comprises an ethylene-vinyl acetate copolymer, an ethylene-propylene-diene (EPDM) ter-polymer, or a combination thereof. For example, the at least one polymer ingredient is a blend of an ethylene-octene copolymer mixed with an ethylene-vinyl acetate copolymer, or a blend of an ethylene-octene copolymer mixed with EPDM. If added, the ethylene-vinyl acetate (EVA) copolymer or EPDM is less than 30 wt. % of the at least one polymer ingredient used in the filled composition in some embodiments. For example, the content of EVA used is about 20 wt. % of total amount of the polymer ingredients in some embodiments.

The at least one metal-containing filler can comprise a metal having an atomic number greater than 50. For example, the at least one metal-containing filler comprises Sb, W, Ba, Pb, Bi, an alloy thereof, an oxide thereof, a salt thereof, or a combination thereof. The salt can be a sulfate, a chloride, or a carbonate of such a suitable metal, and combinations thereof. In some embodiments, the at least one metal-containing filler can be substantially free of Pb, and comprises a filler selected from Sb, W, Bi, a barium salt such as $BaSO_4$, and a combination thereof.

The at least one metal-containing filler can have different combination. The combinations include but are not limited to a mixture of Sb and Bi, a mixture of Sb and W, a mixture of Sb and $BaSO_4$, and a mixture of Bi and $BaSO_4$, a mixture of Sb, Bi and $BaSO_4$, and any other combination. In some embodiments, the at least one metal-containing filler comprises Sb, W, Pb and $BaSO_4$. The use of lighter X-ray absorbing metals such as antimony and bismuth (other than lead) reduces weight, and also provide lead-free products. In some embodiments, the particle size of the at least one metal-containing filler has a particle size in the range from 0.1 micron to 74 microns, for example, in the range from 1 micron to 44 microns.

In some embodiments, the particle size of all the metal-containing fillers are less than or equal to 74 microns. Particle size can be tested on a sieve shaker. For example, the weight percentages of a sample retained on a 150 mesh screen (opening size of 103 microns), a 200 mesh screen (opening size of 74 microns) and a 325 mesh screen (opening size of 43 microns) are determined. Average weight percentage of the particles in these size ranges (95% confidence) can be tested for each of the at least one metal-containing filler. The filled sheet can tolerate a small amount of particles in the range of from 75 microns to 103 microns, but a large amount of these particles are not used because they may serve as stress concentration points, and possibly lead to defects and cracks.

The filled composition can further comprise an additive package comprising at least one additive. Examples of an additive include but are not limited to an oil additive, an antioxidant, a compatibilizer, an adhesion promoter, a processing aid, any other suitable additive and a combination thereof.

Examples of such an oil additive include but are not limited to a paraffinic oil, or an aromatic oil such as naphthenic oil. In some embodiments, such an oil additive is a paraffinic oil, which can comprise saturated rings and long paraffinic side chains. Such an oil additive can be available under trade name SUNOCO SUNPAR from Sunoco. An example of naphthenic oil can be available under trade name NYTEX from NYNAS U.S.A. Inc., Houston, Tex.

Some other suitable additive may include a compatibilizer or an adhesion promoter. Examples of a suitable compatibilizer or adhesion promoter include but are not limited to a polyethylene grafted with maleic anhydride, available under the trademark of FUSABOND® from DuPont. Some other additives can include a fiber filler for reinforcement, and/or self-lubrication. Examples of a suitable fiber filler such as microfibers include but are not limited fibers of nylons, polyester and fluoropolymer such as polytetrafluoroethylene, for example, available under TEFLON® from DuPont.

In some embodiments, the filled composition is uncrosslinked. The uncrosslinked filled composition can be recycled easily after use. In some other embodiments, the filled composition is cross-linkable, and the additive package further comprises an additive such as an initiator, a curing agent, an accelerator, and a combination thereof.

Such a composition can be crosslinked under heating or through moisture ambient conditions. Examples of a suitable initiator or accelerator include but are not limited to peroxides. In some embodiments, the cross-linkable composition can comprise a co-agent such a monomer or oligomer having C=C bonds (e.g., triallyl isocyanurate) to increase cross-linking degree.

In the filled composition, the at least one polymer ingredient is in the range of from about 0.4 wt. % to about 35 wt. %, the at least one metal-containing filler is in the range of from about 50 wt. % to about 95.5 wt. %, and the additive package is in the range of from about 0.1 wt. % to about 15 wt. %. In some embodiments, the at least one polymer ingredient is in the range of from about 1 wt. % to about 25 wt. %, for example, from about 10 wt. % to about 15 wt. %. The at least one metal-containing filler is in the range of from about 60 wt. % to about 95 wt. %, for example, from about 75 wt. % to about 85 wt. %. The additive package is in the range of from about 4 wt. % to about 15 wt. %, for example, from about 5 wt. % to about 10 wt. %.

The additive package can mainly comprise an oil additive. The other additives such as antioxidants and processing aids can be in the range of from about 0.1 wt. % to about 1 wt. %, for example, from about 0.2 wt. % to about 0.5%. In some embodiments, the additive package comprises an oil additive such as paraffinic oil in the range of from about 5 wt. % to about 9 wt. % of the filled composition.

2. Processing and Filled Sheet

Some embodiments also provide a method of making the filled composition as described. In some embodiments, such a method comprises steps of mixing, compounding, and pelletizing.

The filled composition as described can be used to make a filled sheet comprising such a filled composition. In some embodiments, such a method comprises steps of extruding and forming a sheet.

Figure 7:
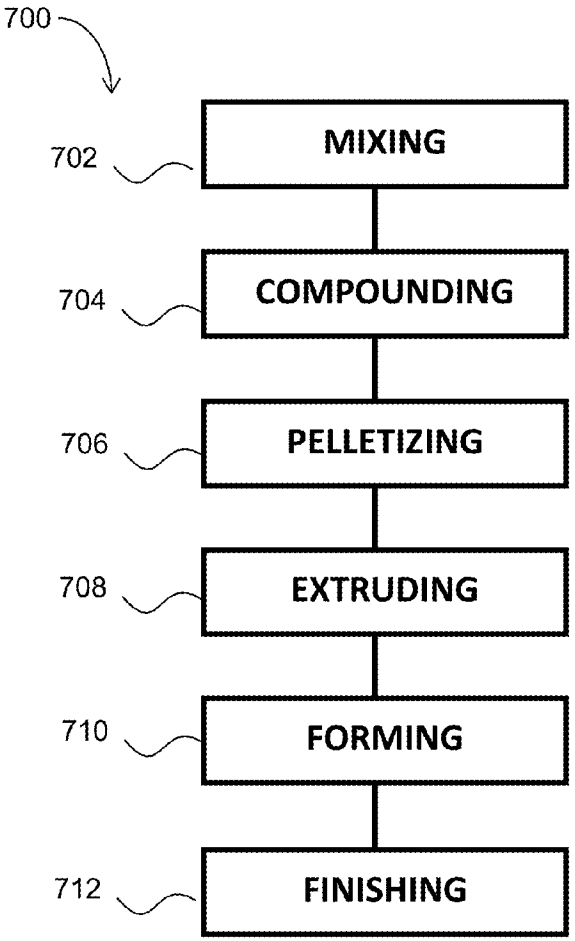
FIG. 7 illustrates a method of making a filled sheet for blocking irradiation such as X-ray in accordance with some embodiments.

FIG. 7 illustrates an exemplary method 700 of making a filled sheet for blocking irradiation such as X-ray in accordance with some embodiments.

At step 702, the ingredients including the at least one polymer ingredient, the at least one metal-containing filler, and the additive package are mixed in a mixer, for example, a batch mixer.

At step 704, the ingredients are compounded to form a filled compound. The compounding can be performed on compounding equipment such as an extruder. Mixing temperatures can range from 240 to 385° F. Mixing time length can range from 15 to 40 minutes. Rotor speed can range from 25 to 35 rpm.

At step 706, pellets can be formed on an extruder having pelletizer.

At step 708, a filled sheet can be extruded. The pellets are fed into the hopper of a single screw extruder operating at 10 to 65 rpm and temperatures from 240 to 385° F. A filled sheet of desired thickness can be formed through a slotted die having a gap of a suitable dimension, for example, in the range from 25 mils to 27 mils.

At step 710, the extruded filled sheet is formed. The extruded sheet can be placed onto a set of rollers, which serve to chill the filled sheet.

In some embodiments, such a method can also comprise a step of curing the composition if the filled composition is designed to be cross-linkable. For example, a heating step can be used to cure the polymer ingredient in a filled composition comprising peroxide.

At step 712, the filled sheet can be finished.

Formation of sheet from the filled compositions is not limited to the above-described method. Variations of this method include the use of a twin screw extruder to form the pellets, or to make sheet directly, and use of a calendaring process to form sheet from pellets.

The resulting filled sheet comprises a filled composition as described. For example, in some embodiments, the filled sheet comprises from about 0.4 wt. % to about 35 wt. % of at least one polymer ingredient, from about 50 wt. % to 95.5 wt. % of at least one metal-containing filler, and from about 0.1 wt. % to about 15 wt. % of an additive package.

The at least one polymer ingredient is selected from the group consisting of a polyolefin elastomer, a polyolefin co-polymer, a polyolefin ter-polymer, and a combination thereof. The polyolefin elastomer, the polyolefin co-polymer, or the polyolefin ter-polymer comprises monomer units is derived from ethylene and at least one vinyl monomer having more than three carbon atoms. In some embodiments, the at least one polymer ingredient comprises a polyolefin elastomer (POE). The POE can be a copolymer of ethylene and at least one vinyl monomer selected from the group consisting of butene, pentene, hexene, heptene, octene and a combination thereof. In some embodiments, the at least one polymer ingredient comprises an olefin block copolymer (OBC). The OBC can be a copolymer of ethylene and at least one vinyl monomer selected from the group consisting of butene, pentene, hexene, heptene, octene and a combination thereof.

The at least one metal-containing filler is selected from a metal filler, a metal compound or a combination thereof. For example, the at least one metal-containing filler comprises Sb, W, Ba, Pb, Bi, an alloy thereof, an oxide thereof, a salt thereof, or a combination thereof. The additive package comprising an additive selected from the group consisting of a paraffinic oil, an aromatic oil, an antioxidant, a compatibilizer, an adhesion promoter, a processing aid, and a combination thereof.

The filled sheet can be uncrosslinked. In some other embodiments, the filled sheet can be crosslinkable or crosslinked. A crosslinkable filled sheet can further comprise an initiator, a curing agent, and/or accelerator. The crosslinkable filled sheet becomes a crosslinked filled sheet after the polymer ingredients are cured (cross-linked).

3. Protective Garment

The filled sheet comprising a filled composition described above is used to make a protective garment for radiation shielding. In some embodiments, as described the filled composition in the protective garment comprises from about 0.4 wt. % to about 35 wt. % of at least one polymer ingredient, from about 50 wt. % to 95.5 wt. % of at least one metal-containing filler, from about 0.1 wt. % to about 15 wt. % of an additive package. The at least one polymer ingredient, selected from the group consisting of a polyolefin elastomer, a polyolefin co-polymer, a polyolefin ter-polymer, and a combination thereof. The polyolefin elastomer, the polyolefin co-polymer, or the polyolefin ter-polymer comprises monomer units derived from ethylene and at least one vinyl monomer having more than three carbon atoms. Examples of the at least one polymer ingredient include but are not limited to a polyolefin elastomer (POE) and an olefin block copolymer (OBC) as described.

In some embodiments, the protective garment further comprises at least one layer of fabric such as nylon, polyester and combinations thereof, as shown in FIG. 2A. For example, in some embodiments, the protective garment comprises two outer layers of fabric 204 and 206, which encase one or more inner layers 208 of filled sheet 202. The exemplary dimensions of different layers are described in FIG. 2A. In some embodiments, several layers of thin sheets 208 are used together, to achieve the desired level of radiation protection. Compared to using one thick filled sheet, the construction with several layers of thin sheets 208 can reduce flexing caused by human motion.

The protective garment can be in a suitable design including but are not limited to a vest-skirt apron, a frontal apron, and a dental apron as shown in FIGS. 1A-1C. The filled composition in the protective garment can be uncrosslinked or crosslinked.

The protective garment can also comprise elastic and Velcro fasteners, which are attached to layers of fabric to secure the protective garment to a wearer's body.

Some embodiments also provide a method of making a protective garment comprising such a filled polymer composition as described, or a protective garment comprising a sheet comprising the filled polymer composition as described.

The filled composition and filled sheet have high efficiency in shielding or blocking radiation, excellent abrasion resistance, flexibility, and environmental stress cracking resistance, for example, after exposure to isopropyl alcohol. The protective garment is configured to shield (or block) radiation, for example, blocking X-rays. The resulting protective garments provide protections to related personnel in dental or medical examination, laboratory and industrial operation, and are expected to last more than two years during normal use.

4. Examples

The following ingredients were used in making the filled compositions (Examples Ex. 1-12) shown in Table 1.

ENGAGE 8150 is a polyolefin elastomer (POE) from Dow Elastomers, which is manufactured using metallocene catalysts, the single-site catalysts, with its polyethylene solution process. ENGAGE 8150 is an ethylene-octene copolymer, having a density of 0.868 g/cm$^3$, and a melt index of 0.5 g/10 min at 190° C. (under 2.16 Kg).

INFUSE 9000 is an olefin block copolymer (OBC) of ethylene and octene, available from Dow Elastomers. INFUSE 9000 has a density of 0.877 g/cm$^3$, and a melt index of 0.5 g/10 min at 190° C. (under 2.16 Kg).

ELVAX 265 is an ethylene-vinyl acetate (EVA) copolymer resin having 28 wt. % of vinyl acetate comonomer content, available from DuPont. ELVAX 265 has a density of 0.951 g/cm$^3$, and a melt index of 3 g/10 min at 190° C. (under 2.16 Kg).

NORDEL IP 3745 is an EPDM terpolymer, available from Dow Elastomer. NORDEL IP 3745 comprises monomer units derived from ethylene (70 wt. %), propylene (30.5 wt. %) and ethylidene norbornene (ENB, 0.5 wt. %), and has a Mooney viscosity of 45 (ML 1+4 at 125° C.).

Lead particles were obtained from Atomized Product Group, Garland, Tex. Its particle size with 95% confidence is less than 103 microns, with about 5 wt. % in the range of 75-103 microns, about 18 wt. % in the range of 44-74 microns, and about 77 wt. % less than 44 microns.

Barium sulfate particles were obtained from Cimbar Performance Minerals, Chatsworth, Ga. Its particle size with 95% confidence is less than 44 microns.

Tungsten particles were obtained from Buffalo Tungsten Depew, New York. Its particle size with 95% confidence is less than 74 microns, with about 14 wt. % in the range of 44-74 microns, and about 86 wt. % less than 44 microns.

Bismuth particles were obtained from 5N Plus Wellingborough, UK or Acupowder, Union, N.J. Its particle size with 95% confidence is less than 74 microns, with about 26 wt. % in the range of 44-74 microns, and about 74 wt. % less than 44 microns.

Antimony particles were obtained from 5N Plus Wellingborough, UK or Acupowder, Union, N.J. Its particle size with 95% confidence is less than 74 microns, with about 16 wt. % in the range of 44-74 microns, and about 84 wt. % less than 44 microns.

SUNPAR 2280 oil is paraffinic oil comprising saturated rings and long paraffinic side chains, available from Sunoco.

NYTEX 5450 oil is naphthenic process oil comprising hydrotreated heavy naphthenic distillate, available from NYNAS U.S.A. Inc., Houston, Tex.

BNX 1225 is an antioxidant and thermal stabilizer blend comprising a primary and a secondary antioxidant, available from Mayzo, Inc, Suwanee, Ga.

KEMAMIDE U is a processing aid or slip agent comprising oleamide, available from Chemtura Corporation, Middlebury, Conn.

The ingredients were first compounded to form pellets using a batch mixer and a pelletizing extruder. Mixing temperatures ranged from 240 to 385° F. Mixing times were 15 to 40 minutes. Rotor speed varied from 25 to 35 rpm. The pellets were subsequently fed into the hopper of a single screw extruder operating at 10 to 65 rpm and temperatures from 240 to 385° F. A filled sheet of desired thickness was formed through a slotted die having a gap of 25-27 mils, and then placed onto a set of rollers which served to chill it, after which it was analyzed for material properties.

The filled sheet of Example 10 (Ex. 10) was formed by mixing the ingredients in a Haake 600 Mixer coupled with a Haake RC-90 Torque Rheometer followed by pressing to desired thickness using a Carver hydraulic press equipped with heated platens.

During extrusion of a highly filled composition, a "die clean" is generally performed after two rolls of sheets are produced. The reason is that a bead of liquid extrudate, commonly called "die drool," continuously and gradually builds up at the exit of the die. If not removed, the bead eventually breaks apart and forms whisker-like fragments on the sheet, resulting in defects. During a "die clean," the operator manually scrapes the drool off, a procedure which results in a loss of about 6 feet of sheet. However, during extrusion of the Examples, it was not necessary to clean the die after two rolls were produced. A die drool can be eliminated.

It was also observed using a digital X-ray machine that a filled sheet made from the Examples had a homogenous dispersion of the metal powder. This is also a processing advantage, as it reduces the amount of material that might be rejected due to nonuniformity, leading to increased "in-spec" output.

As shown in Table 2, six Comparative Examples of commercially available radiation blocking sheets are based on other polymers and additives. The lead equivalences of these sheets ranged from 0.125 to 0.25 mm based on the product specifications The above-described X-ray blocking sheets were tested for one or more of the following: flex-crack resistance and rate of crack growth, abrasion resistance under variable levels of stress, tensile properties, tear strength, Durometer Shore A hardness, compressive modulus, drape coefficient, and resistance to isopropyl alcohol. The tensile properties include modulus of toughness and specific energy of absorption calculated from modulus of toughness and specific gravity.

(1) Flex Crack Resistance and Rate of Crack Growth

"Flex cracking" can be defined as a cracking condition of the surface of rubbery articles, resulting from repeated bending or flexing of the part. Flex crack resistance of a filled sheet without any pre-crack was evaluated on a DeMattia flex test apparatus developed by the Akron Rubber Development Laboratory (ARDL), following ASTM D 813. The method involved fatigue cycling at prescribed intervals followed by inspection of each specimen. A TeleSensory visual system consisting of a lens, image detection device, and screen, magnified the image at 36×. The length of a crack, which grew horizontal (parallel to the folding direction), was measured on the screen using a ruler.

Figure 8:
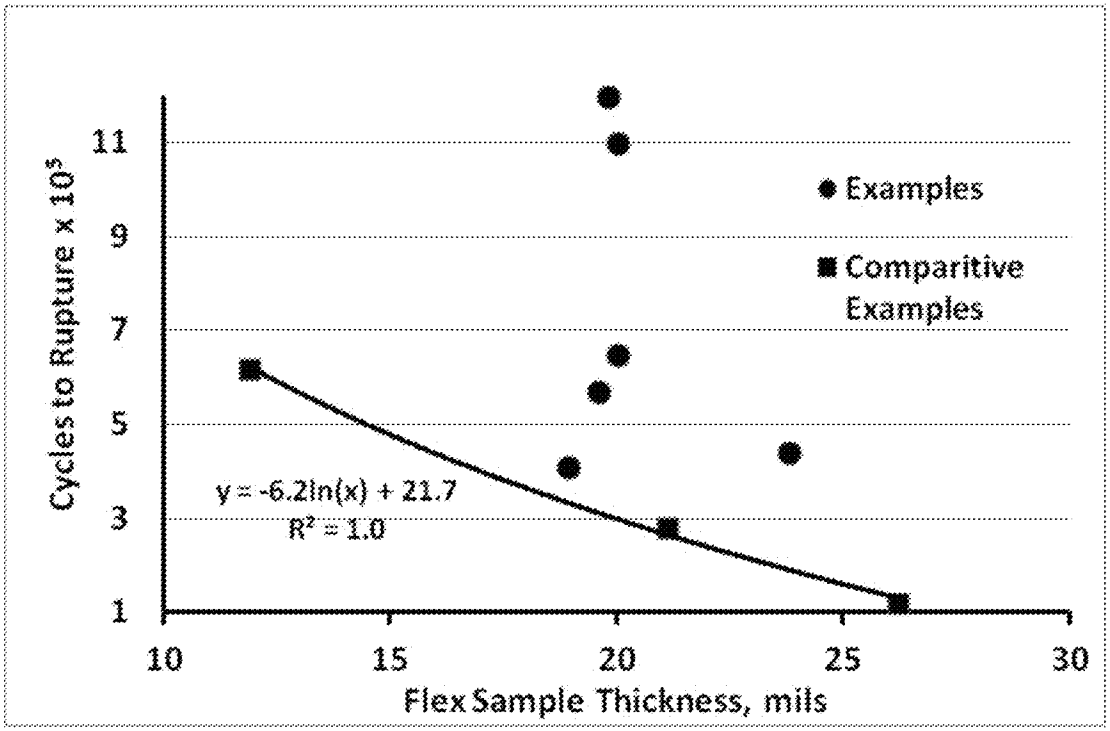
FIG. 8 shows the relationship between flex cycles to rupture and thickness of the filled sheets of some Comparative Examples and Examples.
Figure 9:
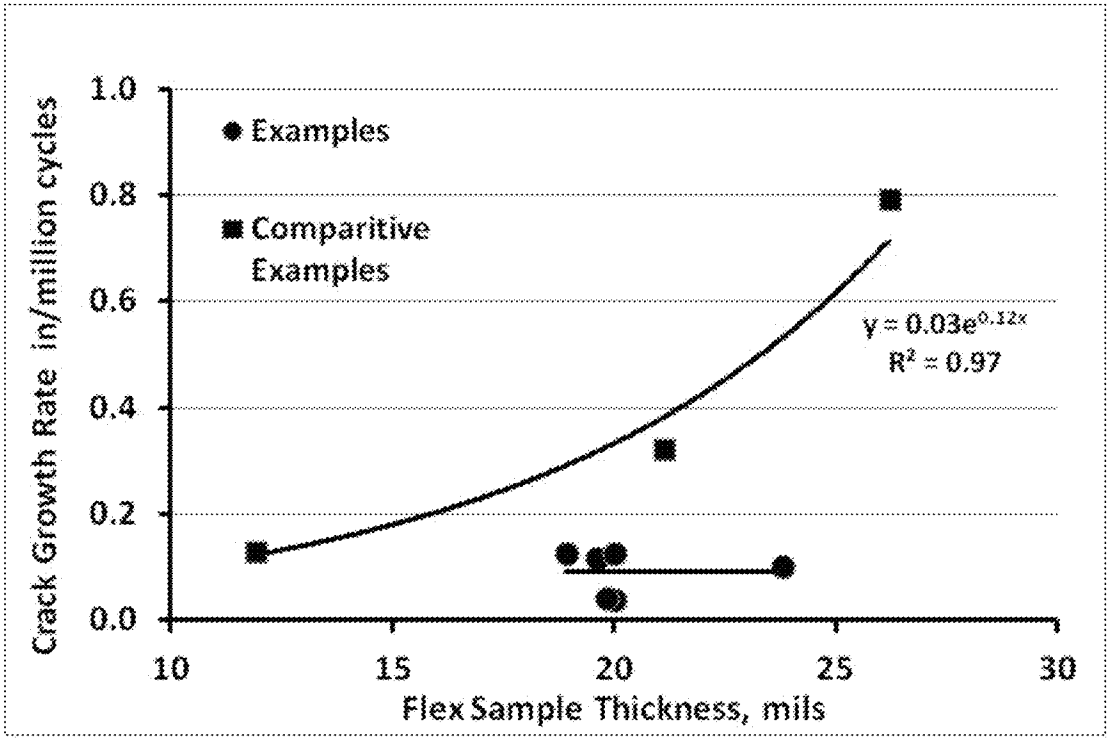
FIG. 9 shows the relationship between rate of crack growth and thickness of the filled sheets of the Comparative Examples and some Examples.

Testing results of flex cycles to rupture were plotted against thickness of filled sheets of the comparative examples (commercial products) as shown in FIG. 8, and fitted to have an equation for prediction purpose. The result of flex cycles to rupture of a working example was compared to a corresponding predicted value based on the fitted equation and then a percentage increase was then calculated. Similarly, testing results of rates of crack growth were plotted against thickness of filled sheets of the comparative examples as shown in FIG. 9, and fitted to have an equation for prediction purpose. The result of rate of crack growth of a working example at a certain thickness was compared to a corresponding predicted value based on the corresponding fitted equation and then a percentage decrease was the calculated.

(2) Abrasion Resistance Under Variable Levels of Stress

"Abrasion resistance" is defined as the resistance of a material to loss of surface particles due to frictional forces. A testing procedure was developed to assess the resistance of a filled sheet to an especially aggressive situation: application of different amounts of stress during abrasion in combination with moderate flexing action.

Figure 10:
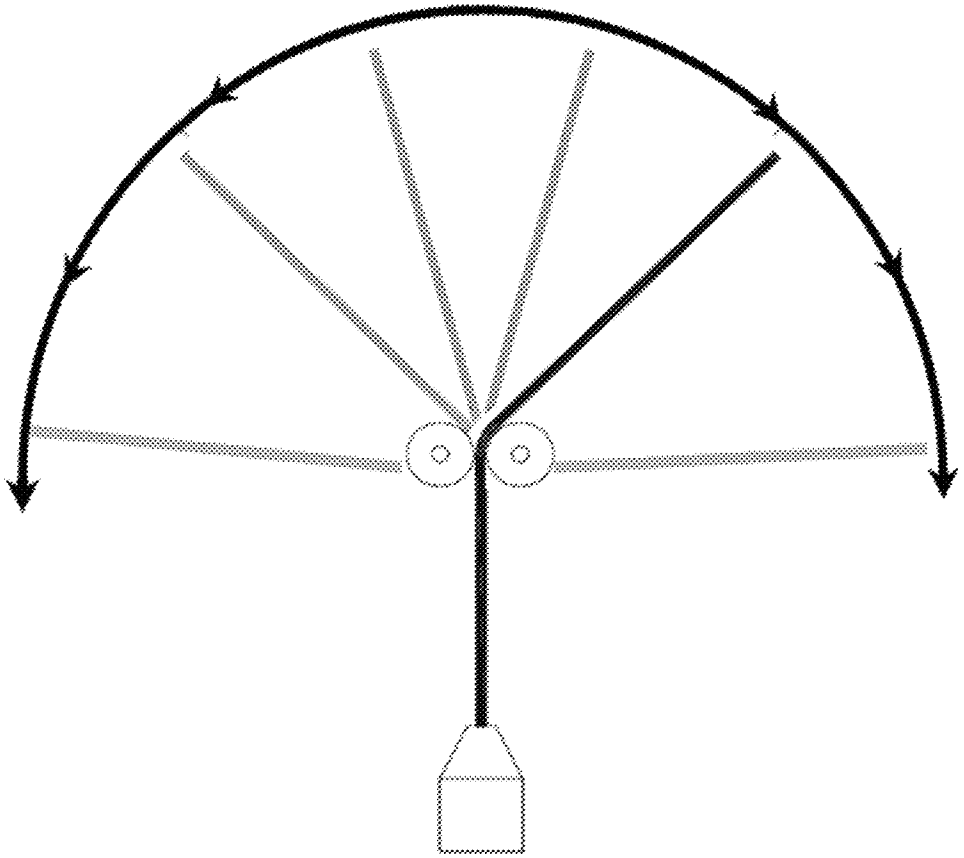
FIG. 10 is a schematic illustration showing a "Tick Tock" flex tester incorporating abrasive surface.

A "Tick Tock" flex tester was employed and adapted for this purpose, as shown in FIG. 10. The test involved securing 14×150 mm strips of a filled sheet to the arm of the tester, attaching weights to the lower ends of the strips to achieve 20 to 95 psi, and swinging (cycling) the arm back and forth through a 180-degree arc with a 3-inch radius at a rate of 60 cycles per minute. The action rubbed both surfaces of the strip against two posts that were covered with P600 sandpaper with average grit size of 25.8 microns made by 3M. Eventually, most strips wore away and broke. A counter recorded the number of cycles to break a strip.

(3) Tensile Properties

Tensile properties of a filled sheet were tested following ASTM D412. Tensile properties obtained included the ultimate tensile strength, percent elongation at break, and elastic modulus. The area under the stress-strain curve was numerically integrated to determine the energy absorbed in deforming the rubbery sheet to its breaking point, which is also known as the "modulus of toughness." Measured values of the specific gravities of each material enabled the specific energy of absorption to be determined from the modulus of toughness.

(4) Tear Strength

Tear resistance was determined according to ASTM D-624, Die C (Graves). Die C produces a non-nicked sample. Rupture or tear initiation strength was measured at the stress concentration located at the 90° apex.

(5) Durometer Hardness, Shore A

Durometer hardness (Shore A) was measured following ASTM D 2240-05. The compressive moduli of the sheets were then estimated from the Durometer readings.

(6) Drape Coefficient

Drape is the ability of a fabric to fall under its own weight into wavy folds. The method of mass measurement for determination of the drape coefficient was employed to assess the tendency of several X-ray blocking sheets to form wavy ripples when worn. As an indicator of their relative stiffness, "drape coefficient" is defined as the fraction of the area of an annular ring placed concentrically above a draped fabric covered by the projection of the draped sample. The higher the drape coefficient a filled sheet has, the less drapeable or stiffer the filled sheet is. A material with a low drape coefficient is desirable.

In the experiment, a filled sheet was cut into circles of 12.6 inches in diameter and placed on a post of 3.8 inches in diameter and 7.25 inches in height. A light was mounted 76.75 inches above the filled sheet, and the shadows were traced onto paper for measurement. Drape coefficient was then calculated.

(7) Effect of Treatment with Isopropyl Alcohol: Comparison of Stress-Strain Plots and Drape Coefficient The sensitivity of filled sheets to isopropyl alcohol was determined by measuring the changes in the tensile properties and drape coefficient. Filled sheets were soaked in 99% isopropyl alcohol for 10 and 60 minutes, respectively. After dried in air, the filled sheets were tested.

TABLE 1

| Composition | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|
| ENGAGE 8150 | 12.4 | 12 | 10.5 | 10.8 | 13.1 | 11.7 | 9.8 | | 6.6 | 5.9 | | 1 |
| INFUSE 9000 | | | | | | | | 13.9 | 6.6 | 5.9 | | |
| ELVAX 265 | | | | | | | 2.4 | | | | 11.6 | 9.8 |
| NORDEL IP 3745 | | | | | | | 0.1 | | | | 0.5 | 0.4 |
| Lead | | | | 28.7 | | | | | | | | 29.1 |
| Barium sulfate | | | | 4.3 | | | | | 71.2 | 43.9 | 0 | 4.3 |
| Tungsten | | | 24.5 | 1.3 | | | | | | | | 1.4 |
| Bismuth | 16.9 | | | | 16.9 | 17.2 | 16.9 | 16.6 | 10.8 | 13.2 | 16.7 | |

TABLE 1-continued

| Composition | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|
| Antimony | 62.1 | 79.9 | 57.8 | 47.1 | 62.1 | 62.9 | 62.7 | 64.6 | 0 | 25.8 | 64.9 | 47.7 |
| SUNPAR 2280 oil | 8.2 | 7.7 | 6.8 | 7.4 | 7.5 | 7.9 | 6.6 | 4.6 | 4.6 | 5 | | 0.7 |
| NYTEX 5450 oil | | | | | | | 1.3 | | | | 6.1 | 5.4 |
| BNX 1225 | 0.2 | 0.2 | 0.2 | 0.2 | 0.2 | 0.2 | | | | | | |
| KEMAMIDE U | 0.2 | 0.2 | 0.2 | 0.2 | 0.2 | 0.1 | 0.2 | 0.3 | 0.2 | 0.3 | 0.2 | 0.2 |
| Total (wt. %) | 100.0 | 100.0 | 100 | 100.0 | 100 | 100.0 | 100.0 | 100 | 100.0 | 100 | 100.0 | 100.0 |

TABLE 2

| Comparative Examples | Carrier |
|---|---|
| CEx1 | PVC/plasticizer |
| CEx2 | Rubber/oil |
| CEx3 | PVC/plasticizer |
| CEx4 | PVC/plasticizer |
| CEx5 | PVC/plasticizer |
| CEx6 | Rubber/oil |

5. Testing Results

Table 3 summarizes the testing results including tensile properties, tear resistance and hardness of the Examples (Ex. 1-11) and the Comparative Examples (CEx 1-6).

(1) Increased Flex Crack Resistance Compared to Comparative Examples for the Same Sheet Thickness Table 4 shows results of flex-cracking from the mini-DeMattia flex test. The data of Comparative Examples were used for plotting and fitting the curve of FIG. 8.

Table 5 and Table 6 show the flex crack resistance and the crack growth rate of Examples 1-6. The data show that filled sheets formed from the compositions of Examples 1-6 require an average of 141% (ranging 18%-276%) more flex cycles to rupture, compared to filled sheet formed from the comparative controls (commercial products) at the same thickness. Filled sheets formed from the filled compositions provided in the present disclosure also grow flex cracks at a speed of an average of 72% (ranging from 55%-88%) slower compared to filled sheet formed from the comparative controls. Thus, the filled compositions in the present disclosure produce filled sheets with superior flex-crack resistance.

TABLE 3

| | CEx1 | CEx2 | CEx3 | CEx4 | CEx5 | CEx6 | Ex. 1 | Ex. 2 | Ex. 3 |
|---|---|---|---|---|---|---|---|---|---|
| Ultimate Tensile Strength, psi | 271 | 688 | 611 | 393 | 889 | 782 | 642 | 555 | 587 |
| Percent Elongation at Break | 164 | 408 | 224 | 232 | 47 | 331 | 897 | 793 | 909 |
| 5% Modulus, psi | 107 | 199 | 221 | 37 | 208 | 133 | 102 | 97 | 92 |
| Elastic Modulus, psi | 1315 | 2405 | 2987 | 2106 | 3293 | 2044 | 1472 | 1940 | 1312 |
| Modulus of Toughness psi | 315 | 1519 | 987 | 614 | 288 | 1809 | 2833 | 2121 | 2669 |
| Specific Energy of Absorption kJ/kg | 0.6 | 2.8 | 1.5 | 1.2 | 0.6 | 3.3 | 7.2 | 5.5 | 6.0 |
| Specific gravity | 3.85 | 3.73 | 4.41 | 3.55 | 3.33 | 3.73 | 2.73 | 2.65 | 3.07 |
| Tear Strength, lb/in | 53 | 115 | 84 | 71 | — | 77 | 79 | 68 | 72 |
| Shore A hardness | 84 | 67 | 84 | 79 | 82 | 68 | 60 | 58 | 60 |
| Compressive modulus, psi per (68) | 2119 | 1137 | 2119 | 1769 | | 1179 | 903 | 854 | 903 |
| Drape Coefficient % (thickness, mils) | 21 (11.9) | 32 (32.8) | 31 (16.2) | | | | 25 (20) | 25 (20) | 24 (19) |

| | Ex. 4 | Ex. 5 | Ex. 6 | Ex. 7 | Ex. 8 | Ex. 9 | Ex. 10 | Ex. 11 |
|---|---|---|---|---|---|---|---|---|
| Ultimate Tensile Strength, psi | 536 | 656 | 622 | 623 | 588 | 403 | 390 | 685 |
| Percent Elongation at Break | 912 | 842 | 855 | 775 | 798 | 644 | 660 | 604 |
| 5% Modulus, psi | 182 | — | — | — | — | — | — | 211 |
| Elastic Modulus, psi | 2400 | — | — | — | — | — | — | 2697 |
| Modulus of Toughness psi | 2872 | 2898 | 2804 | 2664 | 2749 | 1593 | 1661 | 1955 |
| Specific Energy of Absorption kJ/kg | 6.4 | 7.1 | 7.0 | 6.4 | 6.4 | 4.4 | 4.1 | 4.3 |
| Specific gravity | 3.07 | 2.81 | 2.78 | 2.87 | 2.95 | 2.52 | 2.81 | 3.15 |
| Tear Strength, lb/in | 119 | 79 | 76 | 85 | 125 | 84 | 71 | — |
| Shore A hardness | 71 | 63 | 60 | 59 | 72 | 76 | 71 | 70 |
| Compressive modulus, psi per (68) | 1316 | 991 | 903 | 877 | 1365 | 1584 | 1316 | 1268 |
| Drape Coefficient % (thickness, mils) | 19 (17) | 27 (17.8) | | | | | | |

TABLE 4

| | CEx1 | CEx2 | CEx3 | Ex. 1 | Ex. 2 | Ex. 3 | Ex. 4 | Ex. 5 | Ex. 6 |
|---|---|---|---|---|---|---|---|---|---|
| Sheet Thickness, mil | 11.9 | 21.1 | 26.2 | 20.0 | 20.0 | 23.8 | 18.9 | 19.8 | 19.6 |
| Rate of crack growth inches/M cycles | 0.13 | 0.32 | 0.79 | 0.041 | 0.13 | 0.10 | 0.13 | 0.043 | 0.12 |
| Flex cycles to hole formation $\times 10^5$ | 6.2 | 2.8 | 1.2 | 11.0 | 6.5 | 4.4 | 4.1 | 12.0 | 5.7 |

TABLE 5

| | Ex. 1 | Ex. 2 | Ex. 3 | Ex. 4 | Ex. 5 | Ex. 6 |
|---|---|---|---|---|---|---|
| Sheet Thickness, mils | 20 | 20 | 23.8 | 18.9 | 19.8 | 19.6 |
| Flex cycles to hole formation $\times 10^5$ | 11 | 6.5 | 4.4 | 4.1 | 12 | 5.7 |
| Predicted flex cycles to hole formation $\times 10^5$* | 3.1 | 3.1 | 2.0 | 3.5 | 3.2 | 3.3 |
| % Increase compared to prediction | 252% | 108% | 115% | 18% | 276% | 75% |

*predictions from curve generated by current art data in FIG. 8

TABLE 6

| | Ex. 1 | Ex. 2 | Ex. 3 | Ex. 4 | Ex. 5 | Ex. 6 |
|---|---|---|---|---|---|---|
| Sheet Thickness, mil | 20 | 20 | 23.8 | 18.9 | 19.8 | 19.6 |
| Rate of crack growth inches/M cycles | 0.041 | 0.13 | 0.1 | 0.13 | 0.043 | 0.12 |
| Predicted rate of crack growth inches/M cycles* | 0.33 | 0.33 | 0.52 | 0.29 | 0.32 | 0.32 |
| % Decrease compared to prediction | −88% | −61% | −81% | −55% | −87% | −62% |

*predictions from curve generated by current art data in FIG. 9

(2) Increased Abrasion Resistance Per Mil at High Stress

Figure 11:
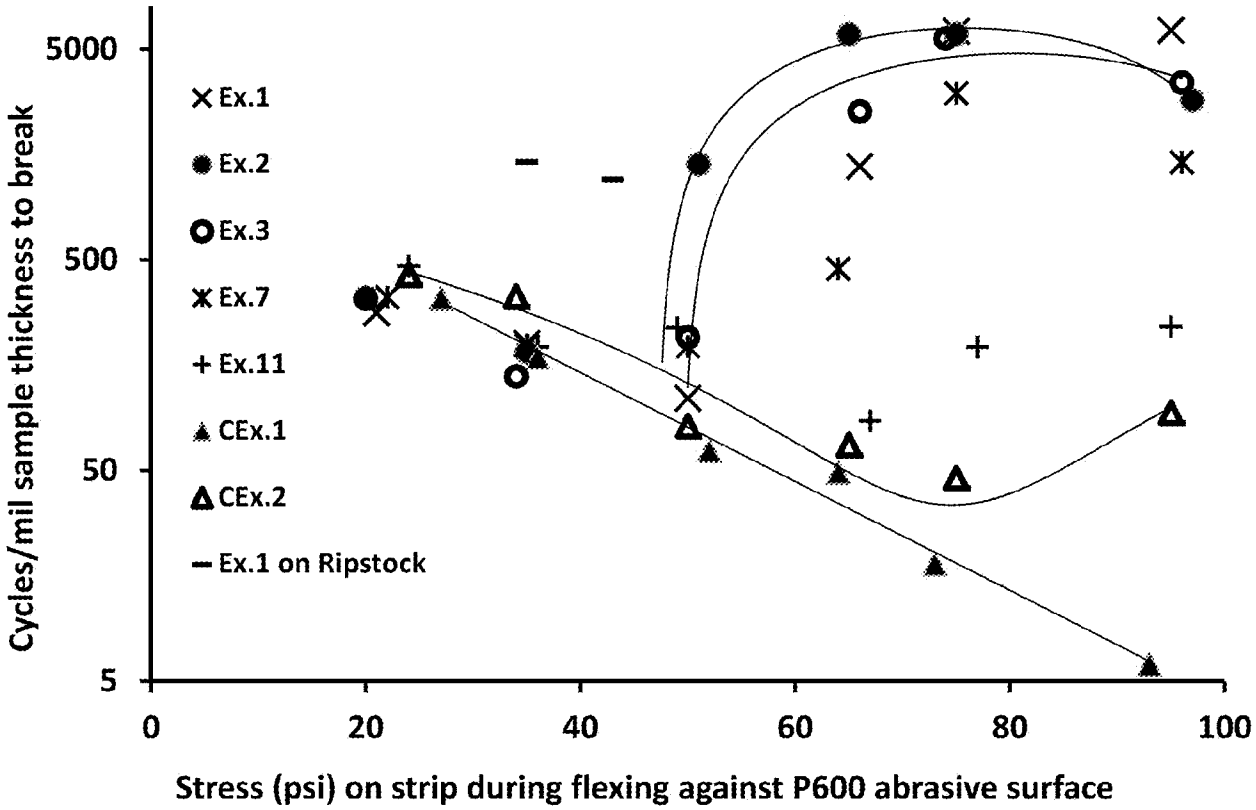
FIG. 11 shows the superior abrasion resistance of the filled sheets provided in this disclosure.

Table 7 and FIG. 11 summarize the results of abrasion resistance. Table 8 shows results of average cycles to break per mil of sample thickness.

At high levels of stress, some filled sheets formed from the filled compositions (Examples) in this disclosure failed to break, even after 120,000 to 130,000 cycles. Consequently, the experiments were ended at this point and the results were calculated. FIG. 11 also shows data points for Ex. 1 and Ex. 2 sheets abraded against a ripstock fabric (nylon/polyester), which is often used in garment construction. The results for abrasion against fabric and sandpaper are at the same order of magnitude; thus the P600 sandpaper is a realistic model surface for a fabric.

The filled sheets formed from the filled compositions (Examples) in this disclosure did not wear away and break as fast as the Comparative Examples when stress levels of 50-95 psi were applied during flex abrasion against P600 sandpaper. The filled sheet formed from the filled compositions of the Examples (e.g., Ex. 1-3, 7 and 11) required about 10 to 100 times the number of cycles per mil thickness to break in this stress range. Based on the stress-strain plots obtained, 50-95 psi imparts 5% of strain at most on the sheet. X-ray blocking garments likely experience such small levels of strain in everyday use.

As shown in Table 8, a blend of POE with approximately 20% EVA (Ex. 7) gave excellent abrasion resistance while a polymer ingredient consisting essentially of EVA copolymer (Ex. 11) displayed lower abrasion resistance compared to Ex. 7, but much better performance than the Comparative Examples.

TABLE 7

| CEx1 | | CEx2 | | Ex. 1 | | Ex. 2 | | Ex. 3 | | Ex. 7 | | Ex. 11 | |
|---|---|---|---|---|---|---|---|---|---|---|---|---|---|
| psi applied | cycles/mil to break | psi applied | cycles/mil to break | psi applied | cycles/mil to break | psi applied | cycles/mil to break | psi applied | cycles/mil to break | psi applied | cycles/mil to break | psi applied | cycles/mil to break |
| 93 | 6 | 95 | 94 | 95 | 6147* | 97 | 2861 | 96 | 3480 | 96 | 1451 | 95 | 241 |
| 73 | 18 | 75 | 46 | 75 | 6091* | 75 | 5904* | 74 | 5628* | 75 | 3090 | 77 | 193 |
| 64 | 49 | 65 | 66 | 66 | 1390 | 65 | 5883* | 66 | 2536* | 64 | 453 | 67 | 86 |
| 52 | 62 | 50 | 81 | 50 | 110 | 51 | 1423 | 50 | 214 | 50 | 194 | 49 | 238 |
| 36 | 173 | 34 | 335 | 35 | 201 | 35 | 183 | 34 | 140 | 35 | 197 | 36 | 193 |
| 27 | 328 | 24 | 425 | 21 | 280 | 20 | 331 | 20 | 327 | 22 | 332 | 24 | 467 |

*One or more strips did not break after 120,000 to 130,000 flex cycles, whereupon the experiment was terminated

TABLE 8

| | Average cycles/mil thickness to break | | | Comparison to Comparative Controls | |
|---|---|---|---|---|---|
| Stress Applied psi ± 2 psi | "Col. A" Plasticized PVC and Rubber/oil (CEx1, CEx2) | "Col. B" POE and POE/EVA (Ex. 1, Ex. 2, Ex. 3, Ex. 7) | "Col C" EVA (Ex. 11) | Ratio of data in "Col. B"/ "Col. A" | Ratio of data in "Col. C"/ "Col. A" |
| 95 | 50 | 2597 | 241 | 52 | 5 |
| 75 | 32 | 3090 | 193 | 97 | 6 |
| 65 | 58 | 922 | 86 | 16 | 1 |
| 50 | 72 | 485 | 238 | 7 | 3 |

(3) Resistance to Alcohol

Table 9 shows tensile properties and drape coefficient of some Examples and Comparative Examples after immersion in isopropyl alcohol (99%, IPA) for 10 and 60 minutes, respectively. Table 10 shows the corresponding percent change of these properties following immersion in isopropyl alcohol (99%) for 60 minutes.

As shown in Tables 9 and 10, the Examples (e.g., Ex. 1, Ex. 2) showed almost no change in tensile properties and drape coefficients after immersion in isopropyl alcohol for 60 minutes. The sheets of comparative examples (e.g., CEx1) formed from plasticized PVC showed substantial changes, for example, an increase of 172% in ultimate tensile strength, a decrease of 94% in elongation, an increase of 248% in drape coefficient and a decrease of 83% of specific energy of absorption. These changes indicate embrittlement, which was also observed by simply touching the treated sheet. The sheet formed from rubber/oil (e.g., CEx2) showed significant changes, particularly in ultimate tensile strength.

TABLE 9

| | CEx1 | | | CEx2 | | | Ex. 1 | | | Ex. 2 | | |
|---|---|---|---|---|---|---|---|---|---|---|---|---|
| | Time of immersion (mins) in isopropyl alcohol (IPA) | | | | | | | | | | | |
| | 0 | 10 | 60 | 0 | 10 | 60 | 0 | 10 | 60 | 0 | 10 | 60 |
| Ultimate Tensile Strength, psi | 271 | 334 | 737 | 688 | 636 | 608 | 642 | 616 | 667 | 555 | 548 | 533 |
| Percent Elongation at Break | 164 | 17 | 10 | 408 | 395 | 392 | 897 | 889 | 868 | 793 | 788 | 783 |
| Modulus of Toughness psi | 315 | 63 | 43 | 1519 | 1432 | 1344 | 2833 | 2824 | 2922 | 2121 | 2108 | 2064 |
| Specific Energy of Absorption kJ/kg | 0.6 | 0.1 | 0.1 | 2.8 | 2.6 | 2.5 | 7.2 | 7.1 | 7.3 | 5.5 | 5.5 | 5.4 |
| Drape Coefficient % (thickness, mils) | 21 (12.2) | 26 | 73 | 32 (32.8) | 34 | 32 | 25 (20) | 24 | 25 | 25 (20) | 24 | 25 |

TABLE 10

| | Percentage Change in Properties after immersion in IPA for 60 minutes | | | |
|---|---|---|---|---|
| | CEx1 | CEx2 | Ex. 1 | Ex. 2 |
| polymer/additive | plasticized PVC | rubber/oil | POE/oil | POE/oil |
| Ultimate Tensile Strength, psi | 172 | −12 | 4 | −4 |
| Percent Elongation at Break | −94 | −4 | −3 | −1 |
| Modulus of Toughness psi | −86 | −12 | 3 | −3 |
| Specific Energy of Absorption kJ/kg | −83 | −11 | 1 | −2 |
| Drape Coefficient % | 248 | −3 | | 4 |

In summary, the filled composition and the filled sheet in the disclosure have excellent abrasion resistance, flexibility, and environmental stress cracking resistance. In addition, the filled composition and the filled sheet also have high efficiency in blocking radiation such as X-rays. The resulting protective garments can be used in related dental or medical examination, laboratory or industrial use, and are expected to last more than two years during normal use.

Although the subject matter has been described in terms of exemplary embodiments, it is not limited thereto. Rather, the disclosure should be construed broadly, to include other variants and embodiments, which may be made by those skilled in the art.

What is claimed is:

1. A filled composition for radiation shielding, comprising:

at least one polymer ingredient selected from the group consisting of a polyolefin elastomer, a polyolefin co-polymer, a polyolefin ter-polymer, and a combination thereof, wherein the polyolefin elastomer, the polyolefin co-polymer, or the polyolefin ter-polymer comprises monomer units derived from ethylene and at least one vinyl monomer being butene or an alkene having at least five carbon atoms; and at least 60 weight percent of at least one metal-containing filler other than $BaSO_4$ the at least one metal-containing filler comprising a metal having an atomic number greater than 50.

2. The filled composition of claim 1, wherein the at least one vinyl monomer has from five to ten carbon atoms.

3. The filled composition of claim 1, wherein the at least one polymer ingredient comprises a polyolefin elastomer (POE).

4. The filled composition of claim 1, wherein the at least one polymer ingredient comprises a polyolefin elastomer (POE), and the POE is a copolymer of ethylene and at least one vinyl monomer selected from the group consisting of butene, pentene, hexene, heptene, octene and a combination thereof.

5. The filled composition of claim 1, wherein the at least one polymer ingredient comprises a polyolefin elastomer (POE) comprising a copolymer of ethylene and octene.

6. The filled composition of claim 1, wherein the at least one polymer ingredient comprises an olefin block copolymer (OBC) having alternating blocks of rigid and elastomeric segments.

7. The filled composition of claim 1, wherein the at least one polymer ingredient comprises an olefin block copolymer (OBC) of ethylene and at least one vinyl monomer selected from the group consisting of butene, pentene, hexene, heptene, octene and a combination thereof.

8. The filled composition of claim 1, wherein the at least one polymer ingredient comprises an olefin block copolymer (OBC) of ethylene and octene.

9. The filled composition of claim 1, wherein
the at least one metal-containing filler comprises Sb, W, Pb, Bi, an alloy thereof, an oxide thereof, a salt thereof, or a combination thereof.

10. The filled composition of claim 1, wherein
the at least one metal-containing filler is substantially free of Pb, and comprises a filler selected from Sb, W, Bi, or a combination thereof; and optionally the filled composition further comprises BaSO4.

11. The filled composition of claim 1, further comprising:
an additive package comprising an additive selected from the group consisting of a paraffinic oil, an aromatic oil, an antioxidant, a compatibilizer, an adhesion promoter, a processing aid, and a combination thereof.

12. The filled composition of claim 11, wherein
the filled composition is cross-linkable, and the additive package further comprises an additive selected from the group consisting of an initiator, a curing agent, an accelerator, and a combination thereof.

13. The filled composition of claim 11, wherein
the at least one polymer ingredient constitutes from about 0.4 weight percent (wt. %) to about 35 wt. % of the filled composition.

14. The filled composition of claim 11, wherein
the at least one polymer ingredient constitutes from about 1 wt. % to about 25 wt. % of the filled composition;
the at least one metal-containing filler constitutes from 60 wt. % to about 95 wt. % of the filled composition; and
the additive package constitutes from about 4 wt. % to about 15 wt. % of the filled composition.

15. The filled composition of claim 11, wherein the filled composition includes:
the at least one polymer ingredient in the range of from about 10 wt. % to about 15 wt. %;
the at least one metal-containing filler in the range of from about 75 wt. % to about 85 wt. %; and
the additive package in the range of from about 5 wt. % to about 10 wt. %.

16. The filled composition of claim 11, wherein
the additive package comprises a paraffinic oil in the range of from about 5 wt. % to about 9 wt. %.

17. A filled sheet for radiation shielding, comprising:
from about 0.4 wt. % to about 25 wt. % of at least one polymer ingredient selected from the group consisting of a polyolefin elastomer, a polyolefin co-polymer, a polyolefin ter-polymer, and a combination thereof, wherein the polyolefin elastomer, the polyolefin co-polymer, or the polyolefin ter-polymer comprises monomer units derived from ethylene and at least one vinyl monomer being butene or an alkene having at least five carbon atoms;
from about 60 wt. % to 95.5 wt. % of at least one metal-containing filler other than $BaSO_4$, the at least one metal-containing filler comprising a metal having an atomic number greater than 50; and
from about 0.1 wt. % to about 15 wt. % of an additive package comprising an additive selected from the group consisting of a paraffinic oil, an aromatic oil, an antioxidant, a compatibilizer, an adhesion promoter, a processing aid, and a combination thereof.

18. The filled sheet of claim 17, wherein
the at least one polymer ingredient comprises a polyolefin elastomer (POE), which is a copolymer of ethylene and at least one vinyl monomer selected from the group consisting of butene, pentene, hexene, heptene, octene and a combination thereof.

19. The filled sheet of claim 17, wherein
the at least one polymer ingredient comprises an olefin block copolymer (OBC) of ethylene and at least one vinyl monomer selected from the group consisting of butene, pentene, hexene, heptene, octene and a combination thereof.

20. The filled sheet of claim 17, wherein
the at least one metal-containing filler comprises Sb, W, Pb, Bi, an alloy thereof, an oxide thereof, a salt thereof, or a combination thereof.

21. A protective garment for radiation shielding, comprising a filled composition comprising:
from about 0.4 wt. % to about 35 wt. % of at least one polymer ingredient selected from the group consisting of a polyolefin elastomer, a polyolefin co-polymer, a polyolefin ter-polymer, and a combination thereof, wherein the polyolefin elastomer, the polyolefin co-polymer, or the polyolefin ter-polymer comprises monomer units derived from ethylene and at least one vinyl monomer being butene or an alkene having at least five carbon atoms;
from about 50 wt. % to 95.5 wt. % of at least one metal-containing filler comprising a metal having an atomic number greater than 50;
from about 0.1 wt. % to about 15 wt. % of an additive package comprising an additive selected from the group consisting of a paraffinic oil, an aromatic oil, an antioxidant, a compatibilizer, an adhesion promoter, a processing aid, and a combination thereof; and
at least one layer of fabric.

22. The protective garment of claim 21, wherein in the filled composition
the at least one polymer ingredient comprises a polyolefin elastomer (POE), which is a copolymer of ethylene and at least one vinyl monomer selected from the group consisting of butene, pentene, hexene, heptene, octene and a combination thereof.

23. The protective garment of claim 21, wherein in the filled composition
the at least one polymer ingredient comprises an olefin block copolymer (OBC) of ethylene and at least one vinyl monomer selected from the group consisting of butene, pentene, hexene, heptene, octene and a combination thereof.

24. The protective garment of claim 21, wherein in the filled composition
the at least one metal-containing filler comprises Sb, W, Ba, Pb, Bi, an alloy thereof, an oxide thereof, a salt thereof, or a combination thereof.

25. The protective garment of claim 21, wherein the protective garment is in a design selected from the group consisting of a vest-skirt apron, a frontal apron, a thyroid collar, a gonad shield, and a dental apron.

26. The protective garment of claim 21, wherein the filled composition is uncrosslinked.

27. The protective garment of claim 21, wherein the filled composition is crosslinked.

* * * * *